US009523155B2

(12) United States Patent
Mayer et al.

(10) Patent No.: US 9,523,155 B2
(45) Date of Patent: Dec. 20, 2016

(54) ENHANCEMENT OF ELECTROLYTE HYDRODYNAMICS FOR EFFICIENT MASS TRANSFER DURING ELECTROPLATING

(71) Applicant: Novellus Systems, Inc., Fremont, CA (US)

(72) Inventors: Steven T. Mayer, Lake Oswego, OR (US); Bryan L. Buckalew, Tualatin, OR (US); Haiying Fu, Camas, WA (US); Thomas Ponnuswamy, Sherwood, OR (US); Hilton Diaz Camilo, Portland, OR (US); Robert Rash, Portland, OR (US); David W. Porter, Sherwood, OR (US)

(73) Assignee: Novellus Systems, Inc., Fremont, CA (US)

( * ) Notice: Subject to any disclaimer, the term of this patent is extended or adjusted under 35 U.S.C. 154(b) by 207 days.

(21) Appl. No.: 14/103,395

(22) Filed: Dec. 11, 2013

(65) Prior Publication Data

US 2014/0183049 A1 Jul. 3, 2014

Related U.S. Application Data

(63) Continuation-in-part of application No. 13/893,242, filed on May 13, 2013.

(Continued)

(51) Int. Cl.

*C25D 17/00* (2006.01)
*C25D 21/22* (2006.01)

(Continued)

(52) U.S. Cl.

CPC . *C25D 5/08* (2013.01); *C25D 7/12* (2013.01); *C25D 17/001* (2013.01); *C25D 21/12* (2013.01)

(58) Field of Classification Search

CPC ..... G01N 27/333; C02F 1/46115; C25D 21/22

(Continued)

(56) References Cited

U.S. PATENT DOCUMENTS 3,652,442 A 3/1972 Powers et al.
3,706,651 A 12/1972 Leland (Continued)

FOREIGN PATENT DOCUMENTS

CN 101220500 A 7/2008
CN 101736376 A 6/2010

(Continued)

OTHER PUBLICATIONS

U.S. Appl. No. 13/110,759, filed May 18, 2011, entitled "High Resistance Ionic Current Source", Abraham et al.

(Continued)

*Primary Examiner* — Zulmariam Mendez

(74) *Attorney, Agent, or Firm* — Weaver Austin Villeneuve & Sampson LLP

(57) ABSTRACT

The embodiments herein relate to methods and apparatus for electroplating one or more materials onto a substrate. In many cases the material is a metal and the substrate is a semiconductor wafer, though the embodiments are no so limited. Typically, the embodiments herein utilize a channeled plate positioned near the substrate, creating a cross flow manifold defined on the bottom by the channeled plate, on the top by the substrate, and on the sides by a cross flow confinement ring. During plating, fluid enters the cross flow manifold both upward through the channels in the channeled plate, and laterally through a cross flow side inlet positioned on one side of the cross flow confinement ring. The flow paths combine in the cross flow manifold and exit at the cross flow exit, which is positioned opposite the cross flow inlet. These combined flow paths result in improved plating uniformity.

22 Claims, 24 Drawing Sheets

Related U.S. Application Data

(60) Provisional application No. 61/736,499, filed on Dec. 12, 2012.

(51) Int. Cl.
*G01N 27/333* (2006.01)
*C25D 5/08* (2006.01)
*C25D 7/12* (2006.01)
*C25D 21/12* (2006.01)

(58) Field of Classification Search
USPC ..... 204/418, 419, 420, 636, 638, 639, 640; 205/80
See application file for complete search history.

(56) References Cited

U.S. PATENT DOCUMENTS 3,862,891 A 1/1975 Smith
4,033,833 A 7/1977 Bestel et al.
4,082,638 A 4/1978 Jumer
4,240,886 A 12/1980 Hodges et al.
4,272,335 A 6/1981 Combs
4,304,641 A 12/1981 Grandia et al.
4,469,564 A 9/1984 Okinaka et al.
4,545,877 A 10/1985 Hillis
4,604,177 A 8/1986 Sivilotti
4,604,178 A 8/1986 Flegener et al.
4,605,482 A 8/1986 Shiragami et al.
4,633,893 A 1/1987 McConnell
4,696,729 A 9/1987 Santini
4,738,272 A 4/1988 McConnell
4,828,654 A 5/1989 Reed
4,856,544 A 8/1989 McConnell
4,906,346 A 3/1990 Hadersbeck et al.
4,931,149 A 6/1990 Stierman et al.
4,933,061 A 6/1990 Kulkarni et al.
5,039,381 A 8/1991 Mullarkey
5,078,852 A 1/1992 Yee et al.
5,096,550 A 3/1992 Mayer et al.
5,146,136 A 9/1992 Ogura et al.
5,156,730 A 10/1992 Bhatt et al.
5,162,079 A 11/1992 Brown
5,217,586 A 6/1993 Datta et al.
5,316,642 A 5/1994 Young, Jr. et al.
5,368,711 A 11/1994 Poris
5,391,285 A 2/1995 Lytle et al.
5,421,987 A 6/1995 Tzanavaras et al.
5,443,707 A 8/1995 Mori
5,472,592 A 12/1995 Lowery
5,476,578 A 12/1995 Forand
5,498,325 A 3/1996 Nishimura et al.
5,516,412 A 5/1996 Andricacos et al.
5,567,300 A 10/1996 Datta et al.
5,660,699 A 8/1997 Saito et al.
5,723,028 A 3/1998 Poris
5,744,019 A 4/1998 Ang
5,935,402 A 8/1999 Fanti
6,004,440 A 12/1999 Hanson et al.
6,027,631 A 2/2000 Broadbent
6,080,291 A 6/2000 Woodruff et al.
6,106,687 A 8/2000 Edelstein
6,126,798 A 10/2000 Reid et al.
6,132,587 A 10/2000 Jorne et al.
6,132,805 A 10/2000 Moslehi
6,179,983 B1 1/2001 Reid et al.
6,193,860 B1 2/2001 Weling
6,228,231 B1 5/2001 Uzoh
6,251,255 B1 6/2001 Copping et al.
6,254,742 B1 7/2001 Hanson et al.
6,261,433 B1 7/2001 Landau
6,368,475 B1 4/2002 Hanson et al.
6,391,166 B1 5/2002 Wang
6,391,188 B1 5/2002 Goosey
6,395,152 B1 5/2002 Wang
6,398,926 B1 6/2002 Mahneke
6,402,923 B1 6/2002 Mayer et al.
6,431,908 B1 8/2002 Beck et al.
6,454,918 B1 9/2002 Sakaki
6,497,801 B1 12/2002 Woodruff et al.
6,521,102 B1 2/2003 Dordi
6,527,920 B1 3/2003 Mayer et al.
6,551,483 B1 4/2003 Mayer et al.
6,627,051 B2 9/2003 Berner et al.
6,632,335 B2 10/2003 Matsuda et al.
6,755,954 B2 6/2004 Mayer et al.
6,773,571 B1 8/2004 Mayer et al.
6,800,187 B1 10/2004 Reid et al.
6,821,407 B1 11/2004 Reid et al.
6,843,855 B2 1/2005 Verhaverbeke
6,869,515 B2 3/2005 Cohen
6,890,416 B1 5/2005 Mayer et al.
6,919,010 B1 7/2005 Mayer
6,921,468 B2 7/2005 Graham et al.
6,964,792 B1 11/2005 Mayer et al.
7,070,686 B2 7/2006 Contolini et al.
7,169,705 B2 1/2007 Ide et al.
D544,452 S 6/2007 Nakamura et al.
D548,705 S 8/2007 Hayashi
D552,565 S 10/2007 Nakamura et al.
D553,104 S 10/2007 Oohashi et al.
7,387,131 B2 6/2008 Kuroda et al.
D587,222 S 2/2009 Sasaki et al.
7,622,024 B1 11/2009 Mayer et al.
7,641,776 B2 1/2010 Nagar et al.
D609,652 S 2/2010 Nagasaka et al.
D609,655 S 2/2010 Sugimoto
7,670,465 B2 3/2010 Yang et al.
D614,593 S 4/2010 Lee et al.
7,837,841 B2 11/2010 Chen et al.
7,854,828 B2 12/2010 Reid et al.
7,935,240 B2 5/2011 Singh et al.
7,967,969 B2 6/2011 Mayer et al.
D648,289 S 11/2011 Mayer et al.
8,308,931 B2 11/2012 Reid et al.
8,795,480 B2 8/2014 Mayer et al.
9,394,620 B2 7/2016 Mayer et al.
9,449,808 B2 9/2016 Buckalew et al.
9,464,361 B2 10/2016 Mayer et al.
2002/0017456 A1 2/2002 Graham et al.
2002/0062839 A1 5/2002 Verhaverbeke et al.
2002/0066464 A1 6/2002 Bergman
2002/0084189 A1 7/2002 Wang et al.
2002/0119671 A1 8/2002 Lee
2002/0125141 A1 9/2002 Wilson et al.
2002/0164840 A1 11/2002 Lu et al.
2002/0166773 A1 11/2002 Cohen
2003/0017647 A1 1/2003 Kwon et al.
2003/0019755 A1 1/2003 Hey et al.
2003/0029527 A1 2/2003 Yajima et al.
2003/0038035 A1 2/2003 Wilson et al.
2003/0102210 A1 6/2003 Woodruff et al.
2003/0201166 A1 10/2003 Zheng et al.
2004/0000487 A1 1/2004 Bonkass et al.
2004/0118694 A1 6/2004 Yang et al.
2004/0149584 A1 8/2004 Nagai et al.
2004/0168926 A1 9/2004 Basol et al.
2004/0231989 A1 11/2004 Kobata et al.
2004/0256238 A1 12/2004 Suzuki et al.
2005/0003737 A1 1/2005 Montierth et al.
2005/0045488 A1 3/2005 Paneccasio et al.
2005/0145482 A1 7/2005 Suzuki et al.
2005/0145499 A1 7/2005 Kovarsky et al.
2005/0161336 A1 7/2005 Woodruff et al.
2005/0181252 A1* 8/2005 Risen, Jr. ..... C08J 5/2268 429/412
2006/0054181 A1 3/2006 Rayandayan et al.
2006/0243598 A1 11/2006 Singh et al.
2007/0015080 A1 1/2007 Toukhy et al.
2007/0029193 A1 2/2007 Brcka
2007/0068819 A1 3/2007 Singh et al.
2010/0032304 A1 2/2010 Mayer et al.
2010/0032310 A1 2/2010 Reid et al.
2010/0044236 A1 2/2010 Mayer et al.

(56) References Cited

U.S. PATENT DOCUMENTS

| | | | |
|---|---|---|---|
| 2010/0116672 | A1 | 5/2010 | Mayer et al. |
| 2011/0031112 | A1 | 2/2011 | Birang et al. |
| 2012/0000786 | A1 | 1/2012 | Mayer et al. |
| 2012/0261254 | A1 | 10/2012 | Reid et al. |
| 2013/0313123 | A1 | 11/2013 | Abraham et al. |
| 2014/0299477 | A1 | 10/2014 | Mayer et al. |
| 2014/0299478 | A1 | 10/2014 | Mayer et al. |
| 2014/0357089 | A1 | 12/2014 | Buckalew et al. |
| 2016/0265132 | A1 | 9/2016 | Graham et al. |

FOREIGN PATENT DOCUMENTS

| | | | |
|---|---|---|---|
| CN | 102330140 | A | 1/2012 |
| CN | 201130081716.6 | | 4/2012 |
| CN | 102459717 | A | 5/2012 |
| CN | 102732924 | A | 10/2012 |
| EP | 0 037 325 | | 3/1981 |
| EP | 0 233 184 | | 8/1987 |
| EP | 1 538 662 | | 6/2005 |
| GB | 2 176 908 | | 1/1987 |
| GB | 2 206 733 | | 1/1989 |
| JP | 59-162298 | | 9/1984 |
| JP | 09-53197 | | 2/1997 |
| JP | 2001-064795 | A | 3/2001 |
| JP | 2001-316887 | | 11/2001 |
| JP | 2002-289568 | | 10/2002 |
| JP | 2003-268591 | | 9/2003 |
| KR | 10-0707121 | | 4/2007 |
| KR | 0657600 | | 8/2012 |
| TW | 591122 | B | 6/2004 |
| TW | D148167 | | 7/2012 |
| WO | WO 87/00094 | | 1/1987 |
| WO | 99/41434 | | 8/1999 |
| WO | WO 02/01609 | | 1/2002 |
| WO | WO 2004/114372 | | 12/2004 |
| WO | WO 2007/128659 | | 11/2007 |
| WO | 2010/144330 | | 12/2010 |

OTHER PUBLICATIONS

US Office Action dated Oct. 26, 2007 issued in U.S. Appl. No. 11/040,359.
US Final Office Action dated Jul. 25, 2008 issued in U.S. Appl. No. 11/040,359.
US Office Action dated Jan. 8, 2009 issued in U.S. Appl. No. 11/040,359.
US Notice of Allowance dated Jul. 20, 2009 issued in U.S. Appl. No. 11/040,359.
US Office Action dated Oct. 6, 2010 issued in U.S. Appl. No. 12/578,310.
US Notice of Allowance dated Mar. 4, 2011 issued in U.S. Appl. No. 12/578,310.
US Office Action dated Oct. 5, 2012 issued in U.S. Appl. No. 13/110,759.
US Office Action dated Sep. 19, 2011 issued in U.S. Appl. No. 12/291,356 .
US Final Office Action dated Feb. 27, 2012 issued in U.S. Appl. No. 12/291,356.
US Notice of Allowance dated Jul. 27, 2012 issued in U.S. Appl. No. 12/291,356.
US Office Action dated Jun. 24, 2011 issued in U.S. Appl. No. 12/481,503.
US Final Office Action dated Mar. 1, 2012 issued in U.S. Appl. No. 12/481,503.
US Office Action dated Jul. 9, 2012 issued in U.S. Appl. No. 12/481,503.
US Final Office Action dated Dec. 19, 2012 issued in U.S. Appl. No. 12/481,503.
US Office Action dated Jun. 24, 2011 issued in U.S. Appl. No. 12/606,030.
US Final Office Action dated Mar. 1, 2012 issued in U.S. Appl. No. 12/606,030.
US Office Action dated Jul. 13, 2012 issued in U.S. Appl. No. 12/606,030.
US Final Office Action dated Dec. 17, 2012 issued in U.S. Appl. No. 12/606,030.
US Notice of Allowance dated Aug. 10, 2011 issued in Design U.S. Appl. No. 29/377,521.
US Office Action dated Jun. 26, 2013 issued in U.S. Appl. No. 13/172,642.
PCT International Search Report and Written Opinion dated Jan. 12, 2011 issued in Application No. PCT/US2010/037520.
CN Office Action dated Jul. 19, 2011 issued in Application No. 201130081716.6.
TW Office Action dated Nov. 28, 2011 issued in Application No. 100301923.
KR Office Action dated Apr. 20, 2012 issued in Application No. 2011-0012881.
"Release of Sabre™ electrofill tool with HRVA by Novellus Systems, Inc." dated prior to the filing date of the instant application (3 pages) Date is unavailable.
*Electrochemical Methods: Fundamentals and Applications*, Bard & Faulkner eds. Chapter 8, Dec. 2000, pp. 280-292.
Fang et al. (2004) "Uniform Copper Electroplating on Resistive Substrates," Abs. 167, 205th Meeting, The Electrochemical Society, Inc., 1 page.
Malmstadt et al. (1994) "Microcomputers and Electronic Instrumentation: Making the Right Connections," American Chemical Society, p. 255.
Schwartz, Daniel T. et al., (1987) "Mass-Transfer Studies in a Plating Cell with a Reciprocating Paddle," *Journal of the Electrochemical Society*, 134(7):1639-1645.
Wilson, Gregory J. et al., (2005) "Unsteady Numerical Simulation of the Mass Transfer within a Reciprocating Paddle Electroplating Cell," *Journal of the Electrochemical Society*, 152(6):C356-C365.
US Final Office Action dated Jan. 15, 2014 issued in U.S. Appl. No. 13/172,642.
US Notice of Allowance dated Mar. 27, 2014 issued in U.S. Appl. No. 13/172,642.
US Office Action dated Aug. 18, 2015 issued in U.S. Appl. No. 14/308,258 .
US Office Action dated Oct. 15, 2014 issued in U.S. Appl. No. 13/904,283.
US Notice of Allowance dated May 5, 2015 issued in U.S. Appl. No. 13/904,283.
CN First Office Action dated Jan. 20, 2015 issued in Application No. 201110192296.8.
CN Second Office Action [no translation] dated Sep. 23, 2015 issued in Application No. 201110192296.8.
TW Office Action dated Apr. 8, 2015 issued in Application No. 100123415.
Lowenheim, (1978) "Electroplating," Sponsored by the American Electroplaters' Society, McGraw-Hill Book Company, New York, p. 139.
U.S. Appl. No. 14/924,124, filed Oct. 27, 2015, entitled "Edge Flow Element for Electroplating Apparatus."
US Office Action dated Jan. 14, 2016 issued in U.S. Appl. No. 14/309,723.
US Office Action dated Nov. 2, 2015 issued in U.S. Appl. No. 13/893,242.
US Notice of Allowance dated Jan. 12, 2016 issued in U.S. Appl. No. 14/308,258.
US Notice of Allowance dated Feb. 1, 2016 issued in U.S. Appl. No. 13/904,283.
Chinese Third Office Action dated Jan. 15, 2016 issued in Application No. CN 201110192296.8.
Taiwan Office Action and Search Report dated Mar. 4, 2016 issued in Application No. TW 104127539.
Austrian Office Action dated Aug. 14, 2014 issued in A50817/2013.
Austrian Search Report dated Dec. 5, 2014 issued in A50817/2013.
Chinese First Office Action dated Nov. 26, 2015 issued in CN 201310683415.9.

(56) References Cited

OTHER PUBLICATIONS

Taiwan Office Action and Search Report dated Aug. 5, 2016 issued in Application No. TW 102117113.
Chinese Second Office Action dated Aug. 3, 2016 issued in CN 201310683415.9.
U.S. Appl. No. 15/291,543, filed Oct. 12, 2016, entitled "Enhancement of Electrolyte Hydrodynamics for Efficient Mass Transfer During Electroplating".
U.S. Appl. No. 15/261,244, filed Sep. 9, 2016, entitled "Control of Electrolyte Hydrodynamics for Efficient Mass Transfer During Electroplating".
U.S. Appl. No. 15/231,623, filed Aug. 8, 2016, entitled "Apparatus for Advanced Packaging Applications".
U.S. Appl. No. 15/225,716 , filed Aug. 1, 2016, entitled "Dynamic Modulation of Cross Flow Manifold During Elecroplating", Thorkelsson et al.
US Notice of Allowability dated Sep. 13, 2016 issued in U.S. Appl. No. 14/309,723.
US Notice of Allowance dated Aug. 2, 2016 issued in U.S. Appl. No. 13/904,283.

* cited by examiner

| Metric | Baseline CIRP | 2.5 mm Protuberance CIRP |
|---|---|---|
| 3D Thickness Variation (½ x 3σ)/AVG | 2.4 μm/min 8.2%<br>3.2 μm/min 8.7% | 2.4 μm/min 5.5%<br>3.2 μm/min 6.7% |
| Coplanarity ½ x (Max-Min)/AVG | 2.4 μm/min 6.1%<br>3.2 μm/min 6.8% | 2.4 μm/min 6.0%<br>3.2 μm/min 6.8% |

FIG. 20

ENHANCEMENT OF ELECTROLYTE HYDRODYNAMICS FOR EFFICIENT MASS TRANSFER DURING ELECTROPLATING

CROSS-REFERENCE TO RELATED APPLICATIONS

This application claims benefit of priority to U.S. Provisional Application No. 61/736,499 filed Dec. 12, 2012, and titled "ENHANCEMENT OF ELECTROLYTE HYDRODYNAMICS FOR EFFICIENT MASS TRANSFER DURING ELECTROPLATING." This application is also a continuation-in-part of U.S. patent application Ser. No. 13/893,242, filed May 13, 2013, and titled "CROSS FLOW MANIFOLD FOR ELECTROPLATING APPARATUS." These applications are incorporated herein by reference in their entireties and for all purposes.

BACKGROUND

The disclosed embodiments relate to methods and apparatus for controlling electrolyte hydrodynamics during electroplating. More particularly, methods and apparatus described herein are particularly useful for plating metals onto semiconductor wafer substrates, especially those having a plurality of recessed features. Example processes and features may include through resist plating of small microbumping features (e.g., copper, nickel, tin and tin alloy solders) having widths less than, e.g., about 50 μm, and copper through silicon via (TSV) features.

Electrochemical deposition processes are well-established in modern integrated circuit fabrication. The transition from aluminum to copper metal line interconnections in the early years of the twenty-first century drove a need for increasingly sophisticated electrodeposition processes and plating tools. Much of the sophistication evolved in response to the need for ever smaller current carrying lines in device metallization layers. These copper lines are formed by electroplating metal into very thin, high-aspect ratio trenches and vias in a methodology commonly referred to as "damascene" processing (pre-passivation metalization).

Electrochemical deposition is now poised to fill a commercial need for sophisticated packaging and multichip interconnection technologies known generally and colloquially as wafer level packaging (WLP) and through silicon via (TSV) electrical connection technology. These technologies present their own very significant challenges due in part to the generally larger feature sizes (compared to Front End of Line (FEOL) interconnects) and high aspect ratios.

Depending on the type and application of the packaging features (e.g., through chip connecting TSV, interconnection redistribution wiring, or chip to board or chip bonding, such as flip-chip pillars), plated features are usually, in current technology, greater than about 2 micrometers and are typically about 5-100 micrometers in their principal dimension (for example, copper pillars may be about 50 micrometers). For some on-chip structures such as power busses, the feature to be plated may be larger than 100 micrometers. The aspect ratio of WLP features is typically about 1:1 (height to width) or lower, though they can range as high as about 2:1 or so, while TSV structures can have very high aspect ratios (e.g., in the neighborhood of about 20:1).

With the shrinking of WLP structure sizes from 100-200 μm to less than 50 μm (e.g., 20 μm) comes a unique set of problems because, at this scale, the size of the feature and the typical mass transfer boundary layer thickness (the distance over which convective transport to a planar surface occurs) are nearly equivalent. For prior generations with larger features, the convective transport of fluid and mass into a feature was carried by the general penetration of the flow fields into the features, but with smaller features, the formation of flow eddies and stagnation can inhibit both the rate and uniformity of mass transport within the growing feature. Therefore, new methods of creating strong uniform mass transfer within smaller "microbump" and TSV features are required.

Not only feature size, but also plating speed differentiates WLP and TSV applications from damascene applications. For many WLP applications, depending on the metal being plated (e.g., copper, nickel, gold, silver solders, etc.), there is a balance between the manufacturing and cost requirements on the one hand and the technical requirements and technical difficulty on the other hand (e.g., goals of capital productivity with wafer pattern variability and on wafer requirements like within die and within feature targets). For copper, this balance is usually achieved at a rate of at least about 2 micrometers/minute, and typically at least about 3-4 micrometers/minute or more. For tin and tin alloy plating, a plating rate of greater than about 3 um/min, and for some applications at least about 7 micrometers/minute may be required. For nickel and strike gold (e.g., low concentration gold flash film layers), the plating rates may be between about 0.1 to 1.5 um/min. At these metal-relative higher plating rate regimes, efficient mass transfer of metal ions in the electrolyte to the plating surface is important.

In certain embodiments, plating must be conducted in a highly uniform manner over the entire face of a wafer to achieve good plating uniformity within a wafer (WIW uniformity), within and among all the features of a particular die (WID uniformity), and also within the individual features themselves (WIF uniformity). The high plating rates of WLP and TSV applications present challenges with respect to uniformity of the electrodeposited layer. For various WLP applications, plating must exhibit at most about 5% half range variation radially along the wafer surface (referred to as WIW non-uniformity, measured on a single feature type in a die at multiple locations across the wafer's diameter). A similar equally challenging requirement is the uniform deposition (thickness and shape) of various features of either different sizes (e.g., feature diameters) or feature density (e.g., an isolated or embedded feature in the middle of an array of the chip die). This performance specification is generally referred to as the WID non-uniformity. WID non-uniformity is measured as the local variability (e.g., <5% half range) of the various features types as described above versus the average feature height or other dimension within a given wafer die at that particular die location on the wafer (e.g., at the mid radius, center or edge).

Another challenging requirement is the general control of the within feature shape. Without proper flow and mass transfer convection control, after plating a line or pillar can end up being sloped in either a convex, flat or concave fashion in two or three dimensions (e.g., a saddle or a domed shape), with a flat profile generally, though not always, preferred. While meeting these challenges, WLP applications must compete with conventional, potentially less expensive pick and place serial routing operations. Still further, electrochemical deposition for WLP applications may involve plating various non-copper metals such as solders like lead, tin, tin-silver, and other underbump metallization (UBM) materials, such as nickel, cobalt, gold, palladium, and various alloys of these, some of which include copper. Plating of tin-silver near eutectic alloys is an example of a plating technique for an alloy that is plated as a lead free solder alternative to lead-tin eutectic solder.

SUMMARY

The embodiments herein relate to methods and apparatus for electroplating material onto a substrate. Generally, the disclosed techniques involve the use of an improved channeled ionically resistive element having a plurality of through holes adapted to provide ionic transport through the plate, as well as a series of protuberances or a step to improve plating uniformity. In one aspect of the embodiments, an electroplating apparatus is provided, including: (a) an electroplating chamber configured to contain an electrolyte an anode while electroplating metal onto a substantially planar substrate; (b) a substrate holder configured to hold the substantially planar substrate such that a plating face of the substrate is separated from the anode during electroplating; (c) an ionically resistive element including: (i) a plurality of channels extending through the ionically resistive element and adapted to provide ionic transport through the ionically resistive element during electroplating; (ii) a substrate-facing side that is substantially parallel to the plating face of the substrate and separated from the plating face of the substrate by a gap; and (iii) a plurality of protuberances positioned on the substrate-facing side of the ionically resistive element; (d) an inlet to the gap for introducing cross flowing electrolyte to the gap; and (e) an outlet to the gap for receiving cross flowing electrolyte flowing in the gap, where the inlet and outlet are positioned proximate azimuthally opposing perimeter locations on the plating face of the substrate during electroplating.

In some embodiments, the gap between the substrate-facing side of the ionically resistive element and the plating face of the substrate is less than about 15 mm, as measured between the plating face of the substrate and an ionically resistive element plane. A gap between the plating face of the substrate and an uppermost height of the protuberances may be between about 0.5-4 mm in certain cases. The protuberances may have a height between about 2-10 mm in certain cases. In various embodiments, the protuberances are oriented, on average, substantially perpendicular to the direction of cross flowing electrolyte. One or more or all of the protuberances may have a length to width aspect ratio of at least about 3:1. In various embodiments, the protuberances are substantially coextensive with the plating face of the substrate.

Many different protuberance shapes may be used. In some cases, at least two different shapes and/or sizes of protuberances are present on the ionically resistive element. One or more protuberances may include a cutout portion through which electrolyte may flow during electroplating. The protuberances may be generally rectangularly shaped, or triangularly shaped, or cylindrically shaped, or some combination thereof. The protuberances may also have a more complicated shape, for example a generally rectangular protuberance with different shapes of cutouts along the top and bottom of the protuberance. In some cases, the protuberances have a triangular upper portion. One example is a rectangular protuberance with a triangular tip. Another example is a protuberance with an overall triangular shape.

The protuberances may extend up from the channeled ionically resistive plate at a normal angle, or at a non-normal angle, or at a combination of angles. In other words, in some embodiments, the protuberances include a face that is substantially normal to an ionically resistive element plane. Alternatively or in addition, the protuberances may include a face that is offset from an ionically resistive element plane by a non-right angle. In some implementations, the protuberances are made from more than one segment. For instance, the protuberances may include a first protuberance segment and a second protuberance segment, where the first and second protuberance segments are offset from the direction of cross flowing electrolyte by angles that are substantially similar but of opposite sign.

The ionically resistive element may be configured to shape an electric field and control electrolyte flow characteristics proximate the substrate during electroplating. In various embodiments, a lower manifold region may be positioned below a lower face of the ionically resistive element, where the lower face faces away from the substrate holder. A central electrolyte chamber and one or more feed channels may be configured to deliver electrolyte from the central electrolyte chamber to both the inlet and to the lower manifold region. In this way, electrolyte may be delivered directly to the inlet to initiate cross flow above the channeled ionically resistive element, and electrolyte may be simultaneously delivered to the lower manifold region where it will pass through the channels in the channeled ionically resistive element to enter the gap between the substrate and the channeled ionically resistive element. A cross flow injection manifold may be fluidically coupled to the inlet. The cross flow injection manifold may be at least partially defined by a cavity in the ionically resistive element. In certain embodiments, the cross flow injection manifold is entirely within the ionically resistive element.

A flow confinement ring may be positioned over a peripheral portion of the ionically resistive element. The flow confinement ring may help redirect flow from the cross flow injection manifold such that it flows in a direction parallel to the surface of the substrate. The apparatus may also include a mechanism for rotating the substrate holder during plating. In some embodiments, the inlet spans an arc between about 90-180° proximate the perimeter of the plating face of the substrate. The inlet may include a plurality of azimuthally distinct segments. A plurality of electrolyte feed inlets may be configured to deliver electrolyte to the plurality of azimuthally distinct inlet segments. Further, one or more flow control elements may be configured to independently control a plurality of volumetric flow rates of electrolyte in the plurality of electrolyte feed inlets during electroplating. In various cases, the inlet and outlet may be adapted to generate cross flowing electrolyte in the gap to create or maintain a shearing force on the plating face of the substrate during electroplating. In certain embodiments, the protuberances may be oriented in a plurality of parallel columns. The columns may include two or more discontinuous protuberances separated by a non-protuberance gap, where the non-protuberance gaps in adjacent columns are substantially not aligned with one another in the direction of cross flowing electrolyte.

In another aspect of the disclosed embodiments, an electroplating apparatus is provided, including: (a) an electroplating chamber configured to contain an electrolyte and an anode while electroplating metal onto a substantially planar substrate; (b) a substrate holder configured to hold a substantially planar substrate such that a plating face of the substrate is separated from the anode during electroplating; (c) an ionically resistive element comprising: (i) a plurality of channels extending through the ionically resistive element and adapted to provide ionic transport through the ionically resistive element during electroplating; (ii) a substrate-facing side that is substantially parallel to the plating face of the substrate and separated from the plating face of the substrate by a gap; and (iii) a step positioned on the substrate-facing side of the ionically resistive element, wherein the step has a height and a diameter, wherein the diameter of the step is substantially coextensive with the plating face of the wafer, and wherein the height and diameter of the step are sufficiently small to allow electrolyte to flow under the substrate holder, over the step and into the gap during plating; (d) an inlet to the gap for introducing electrolyte to the gap; and (e) an outlet to the gap for receiving electrolyte flowing in the gap, where the inlet and outlet are adapted to generate cross flowing electrolyte in the gap to create or maintain a shearing force on the plating face of the substrate during electroplating.

In a further aspect of the disclosed embodiments, a channeled ionically resistive plate for use in an electroplating apparatus to plate material on a semiconductor wafer of standard diameter is provided, including: a plate that is approximately coextensive with a plating face of the semiconductor wafer, where the plate has a thickness between about 2-25 mm; at least about 1000 non-communicating through-holes extending through the thickness of the plate, where the through-holes are adapted to provide ionic transport through the plate during electroplating; and a plurality of protuberances positioned on one side of the plate.

In another aspect of the disclosed embodiments, a channeled ionically resistive plate for use in an electroplating apparatus to plate material on a semiconductor wafer of standard diameter is provided, including: a plate that is approximately coextensive with a plating face of the semiconductor wafer, wherein the plate has a thickness between about 2-25 mm; at least about 1000 non-communicating through-holes extending through the thickness of the plate, wherein the through-holes are adapted to provide ionic transport through the plate during electroplating; and a step comprising a raised portion of the plate in a central region of the plate; a non-raised portion of the plate positioned at the periphery of the plate.

In a further aspect of the disclosed embodiments, a method for electroplating a substrate is provided, including: (a) receiving a substantially planar substrate in a substrate holder, where a plating face of the substrate is exposed, and where the substrate holder is configured to hold the substrate such that the plating face of the substrate is separated from the anode during electroplating; (b) immersing the substrate in electrolyte, where a gap is formed between the plating face of the substrate and an ionically resistive element plane, where the ionically resistive element is at least about coextensive with the plating face of the substrate, where the ionically resistive element is adapted to provide ionic transport through the ionically resistive element during electroplating, and where the ionically resistive element comprises a plurality of protuberances on a substrate-facing side of the ionically resistive element, the protuberances being substantially coextensive with the plating face of the substrate; (c) flowing electrolyte in contact with the substrate in the substrate holder (i) from a side inlet, into the gap, and out a side outlet, and (ii) from below the ionically resistive element, through the ionically resistive element, into the gap, and out the side outlet, where the inlet and outlet are designed or configured to generate cross flowing electrolyte in the gap during electroplating; (d) rotating the substrate holder; and (e) electroplating material onto the plating face of the substrate while flowing the electrolyte as in (c).

In some embodiments, the gap is about 15 mm or less, as measure between the plating face of the substrate and an ionically resistive element plane. A gap between the plating face of the substrate and an uppermost surface of the protuberances may be between about 0.5-4 mm. In certain implementations, the side inlet may be separated into two or more azimuthally distinct and fluidically separated sections, and the flow of electrolyte into the azimuthally distinct sections of the inlet may be independently controlled. Flow directing elements may be positioned in the gap in some cases. The flow directing elements may cause electrolyte to flow in a substantially linear flow path from the side inlet to the side outlet.

In another aspect of the disclosed embodiments, a method for electroplating a substrate is provided, including: (a) receiving a substantially planar substrate in a substrate holder, where a plating face of the substrate is exposed, and where the substrate holder is configured to hold the substrate such that the plating face of the substrate is separated from the anode during electroplating; (b) immersing the substrate in electrolyte, where a gap is formed between the plating face of the substrate and an ionically resistive element plane, where the ionically resistive element is at least about coextensive with the plating face of the substrate, where the ionically resistive element is adapted to provide ionic transport through the ionically resistive element during electroplating, and where the ionically resistive element comprises a step on a substrate-facing side of the ionically resistive element, the step positioned in a central region of the ionically resistive element and surrounded by a non-raised portion of the ionically resistive element; (c) flowing electrolyte in contact with the substrate in the substrate holder (i) from a side inlet, over the step, into the gap, over the step again, and out a side outlet, and (ii) from below the ionically resistive element, through the ionically resistive element, into the gap, over the step, and out the side outlet, where the inlet and outlet are designed or configured to generate cross flowing electrolyte in the gap during electroplating; (d) rotating the substrate holder; and (e) electroplating material onto the plating face of the substrate while flowing the electrolyte as in (c).

These and other features will be described below with reference to the associated drawings.

BRIEF DESCRIPTION OF THE DRAWINGS

FIG. 20 presents experimental data showing that the addition of protuberances on a channeled ionically resistive plate can promote more uniform plating by achieving a lower variation of bump height thickness.

DETAILED DESCRIPTION

Figure 1A:
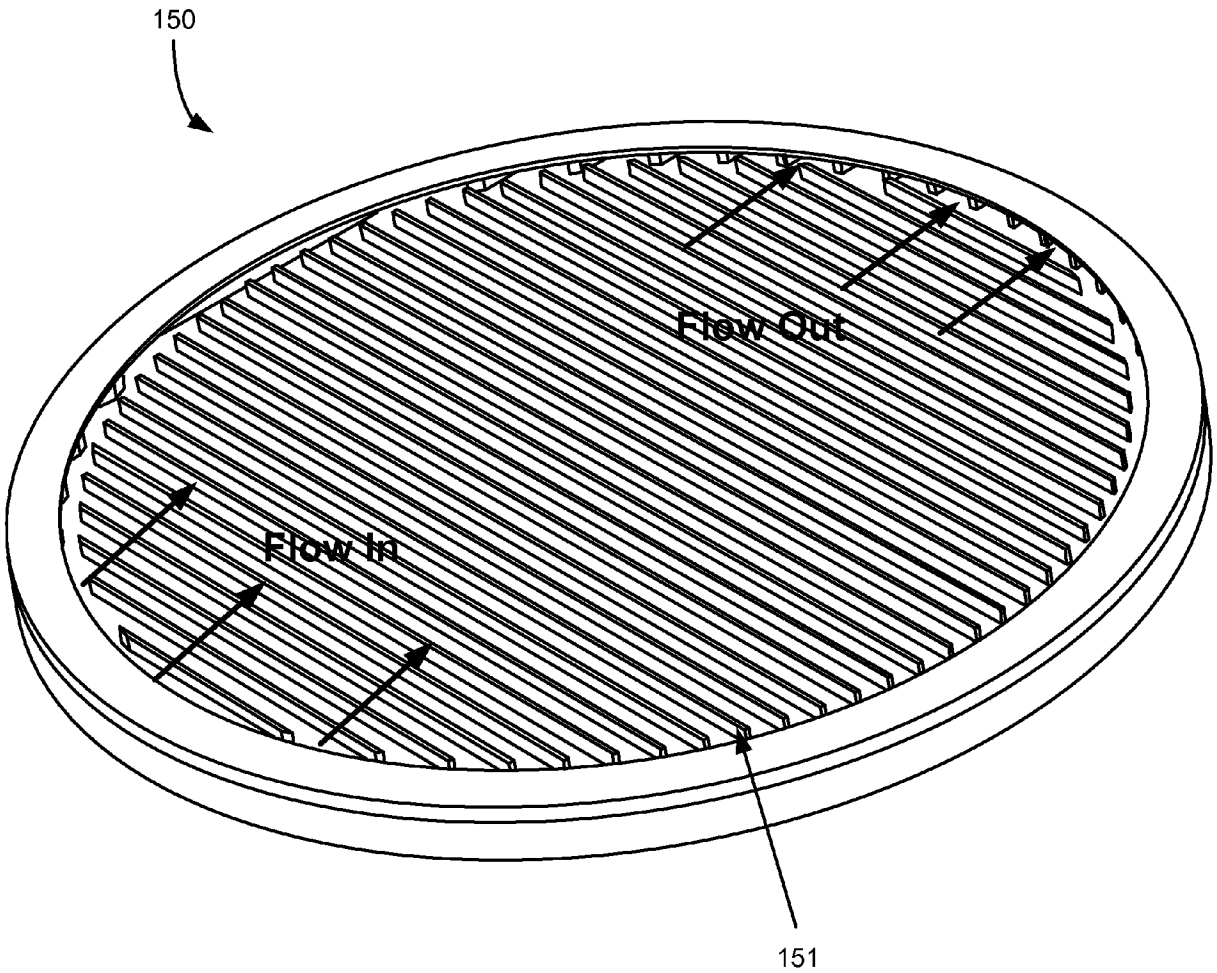
FIG. 1A shows an isometric view of a channeled ionically resistive plate having a collection of protuberances thereon in accordance with certain embodiments.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. The following detailed description assumes the invention is implemented on a wafer. Oftentimes, semiconductor wafers have a diameter of 200, 300 or 450 mm. However, the invention is not so limited. The work piece may be of various shapes, sizes, and materials. In addition to semiconductor wafers, other work pieces that may take advantage of this invention include various articles such as printed circuit boards and the like.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

In the following discussion, when referring to top and bottom features (or similar terms such as upper and lower features, etc.) or elements of the disclosed embodiments, the terms top and bottom are simply used for convenience and represent only a single frame of reference or implementation of the invention. Other configurations are possible, such as those in which the top and bottom components are reversed with respect to gravity and/or the top and bottom components become the left and right or right and left components. Described herein are apparatus and methods for electroplating one or more metals onto a substrate. Embodiments are described generally where the substrate is a semiconductor wafer; however the invention is not so limited.

Disclosed embodiments include electroplating apparatus configured for, and methods including, control of electrolyte hydrodynamics during plating so that highly uniform plated layers are obtained. In specific implementations, the disclosed embodiments employ methods and apparatus that create combinations of impinging flow (flow directed at or perpendicular to the work piece surface) and shear flow (sometimes referred to as "cross flow" or flow with velocity parallel to the work piece surface).

The disclosed embodiments use a channeled ionically resistive plate (CIRP) that provides a small channel (a cross flow manifold) between the plating surface of the wafer and the top of the CIRP. The CIRP serves many functions, among them 1) allowing ionic current to flow from an anode generally located below the CIRP and to the wafer, 2) allowing fluid to flow through the CIRP upwards and generally towards the wafer surface and 3) confining and resisting the flow of electrolyte away from and out of the cross flow manifold region. The flow in the cross flow manifold region is comprised of fluid that is injected through-holes in the CIRP as well as fluid that comes in from a cross flow injection manifold, typically located on the CIRP and to one side of the wafer.

In embodiments disclosed herein, the top face of the CIRP is modified to thereby improve maximum deposition rate and plating uniformity over the face of the wafer and within plating features. The modification on the top face of the CIRP may take the form of a step or collection of protuberances. FIG. 1A provides an isometric view of a CIRP 150 having a collection of protuberances 151 thereon. These CIRP modifications are discussed in more detail below.

In certain implementations, the mechanism for applying cross flow in the cross flow manifold is an inlet with, for example, appropriate flow directing and distributing means on or proximate the periphery of the channeled ionically resistive element. The inlet directs cross flowing catholyte along the substrate-facing surface of the channeled ionically resistive element. The inlet is azimuthally asymmetric, partially following the circumference of the channeled ionically resistive element. The inlet may include one or more gaps or cavities, for example an annular cavity referred to as a cross flow injection manifold positioned radially outside of the channeled ionically resistive element. Other elements are optionally provided for working in concert with the cross flow injection manifold. These may include a cross flow injection flow distribution showerhead, a cross flow confinement ring, and flow-directing fins, which are further described below in conjunction with the figures.

In certain embodiments, the apparatus is configured to enable flow of electrolyte in a direction towards or perpendicular to a substrate plating face to produce an average flow velocity of at least about 3 cm/s (e.g., at least about 5 cm/s or at least about 10 cm/s) exiting the holes of the channeled ionically resistive element during electroplating. In certain embodiments, the apparatus is configured to operate under conditions that produce an average transverse electrolyte velocity of about 3 cm/sec or greater (e.g., about 5 cm/s or greater, about 10 cm/s or greater, about 15 cm/s or greater, or about 20 cm/s or greater) across the center point of the plating face of the substrate. These flow rates (i.e., the flow rate exiting the holes of the ionically resistive element and the flow rate across the plating face of the substrate) are in certain embodiments appropriate in an electroplating cell employing an overall electrolyte flow rate of about 20 L/min and an approximately 12 inch diameter substrate. The embodiments herein may be practiced with various substrate sizes. In some cases, the substrate has a diameter of about 200 mm, about 300 mm, or about 450 mm. Further, the embodiments herein may be practiced at a wide variety of overall flow rates. In certain implementations, the overall electrolyte flow rate is between about 1-60 L/min, between about 6-60 L/min, between about 5-25 L/min, or between about 15-25 L/min. The flow rates achieved during plating may be limited by certain hardware constraints, such as the size and capacity of the pump being used. One of skill in the art would understand that the flow rates cited herein may be higher when the disclosed techniques are practiced with larger pumps.

In some embodiments, the electroplating apparatus contains separated anode and cathode chambers in which there are different electrolyte compositions, electrolyte circulation loops, and/or hydrodynamics in each of two chambers. An ionically permeable membrane may be employed to inhibit direct convective transport (movement of mass by flow) of one or more components between the chambers and maintain a desired separation between the chambers. The membrane may block bulk electrolyte flow and exclude transport of certain species such as organic additives while selectively permitting transport of ions such as only cations (cationic exchange membrane) or only anions (anionic exchange membrane). As a specific example, in some embodiments, the membrane includes the cationic exchange membrane NAFION™ from DuPont of Wilmington, Del., or a related ionically selective polymer. In other cases, the membrane does not include an ion exchange material, and instead includes a micro-porous material. Conventionally, the electrolyte in the cathode chamber is referred to as "catholyte" and the electrolyte in the anode chamber is referred to as "anolyte." Frequently, the anolyte and catholyte have different compositions, with the anolyte containing little or no plating additives (e.g., accelerator, suppressor, and/or leveler) and the catholyte containing significant concentrations of such additives. The concentration of metal ions and acids also often differs between the two chambers. An example of an electroplating apparatus containing a separated anode chamber is described in U.S. Pat. No. 6,527,920, filed Nov. 3, 2000; U.S. Pat. No. 6,821,407, filed Aug. 27, 2002, and U.S. Pat. No. 8,262,871, filed Dec. 17, 2009 each of which is incorporated herein by reference in its entirety.

In some embodiments, the membrane need not include an ion exchange material. In some examples, the membrane is made from a micro-porous material such as polyethersulfone manufactured by Koch Membrane of Wilmington, Mass. This membrane type is most notably applicable for inert anode applications such as tin-silver plating and gold plating, but may also be used for soluble anode applications such as nickel plating.

In certain embodiments, and as described more fully elsewhere herein, catholyte may flow through one of two main pathways within an electroplating cell. In a first pathway, catholyte is fed into a manifold region, referred to hereafter as the "CIRP manifold region" located below the CIRP and generally (but not necessarily) above a cell membrane and/or membrane frame-holder. From the CIRP manifold region, the catholyte passes upwards through the various holes in the CIRP, into the CIRP to substrate gap (often referred to as the cross flow or cross flow manifold region), traveling in a direction toward the wafer surface. In a second cross-flow electrolyte-feeding pathway, catholyte is fed from one side of and into a cross flow injection manifold region. From the cross flow injection manifold, the catholyte passes into the CIRP to substrate gap (i.e., the cross flow manifold), where it flows over the surface of the substrate in a direction that is largely parallel to the surface of the substrate.

While some aspects described herein may be employed in various types of plating apparatus, for simplicity and clarity, most of the examples will concern wafer-face-down, "fountain" plating apparatus. In such apparatus, the work piece to plated (typically a semiconductor wafer in the examples presented herein) generally has a substantially horizontal orientation (which may in some cases vary by a few degrees from true horizontal for some part of, or during the entire plating process) and may be powered to rotate during plating, yielding a generally vertically upward electrolyte convection pattern. Integration of the impinging flow mass from the center to the edge of the wafer, as well as the inherent higher angular velocity of a rotating wafer at its edge relative to its center, creates a radially increasing sheering (wafer parallel) flow velocity. One example of a member of the fountain plating class of cells/apparatus is the Sabre® Electroplating System produced by and available from Novellus Systems, Inc. of San Jose, Calif. Additionally, fountain electroplating systems are described in, e.g., U.S. Pat. No. 6,800,187, filed Aug. 10, 2001 and U.S. Pat. No. 8,308,931, filed Nov. 7, 2008, which are incorporated herein by reference in their entireties.

The substrate to be plated is generally planar or substantially planar. As used herein, a substrate having features such as trenches, vias, photoresist patterns and the like is considered to be substantially planar. Often these features are on the microscopic scale, though this is not necessarily always the case. In many embodiments, one or more portions of the surface of the substrate may be masked from exposure to the electrolyte.

Figure 1B:
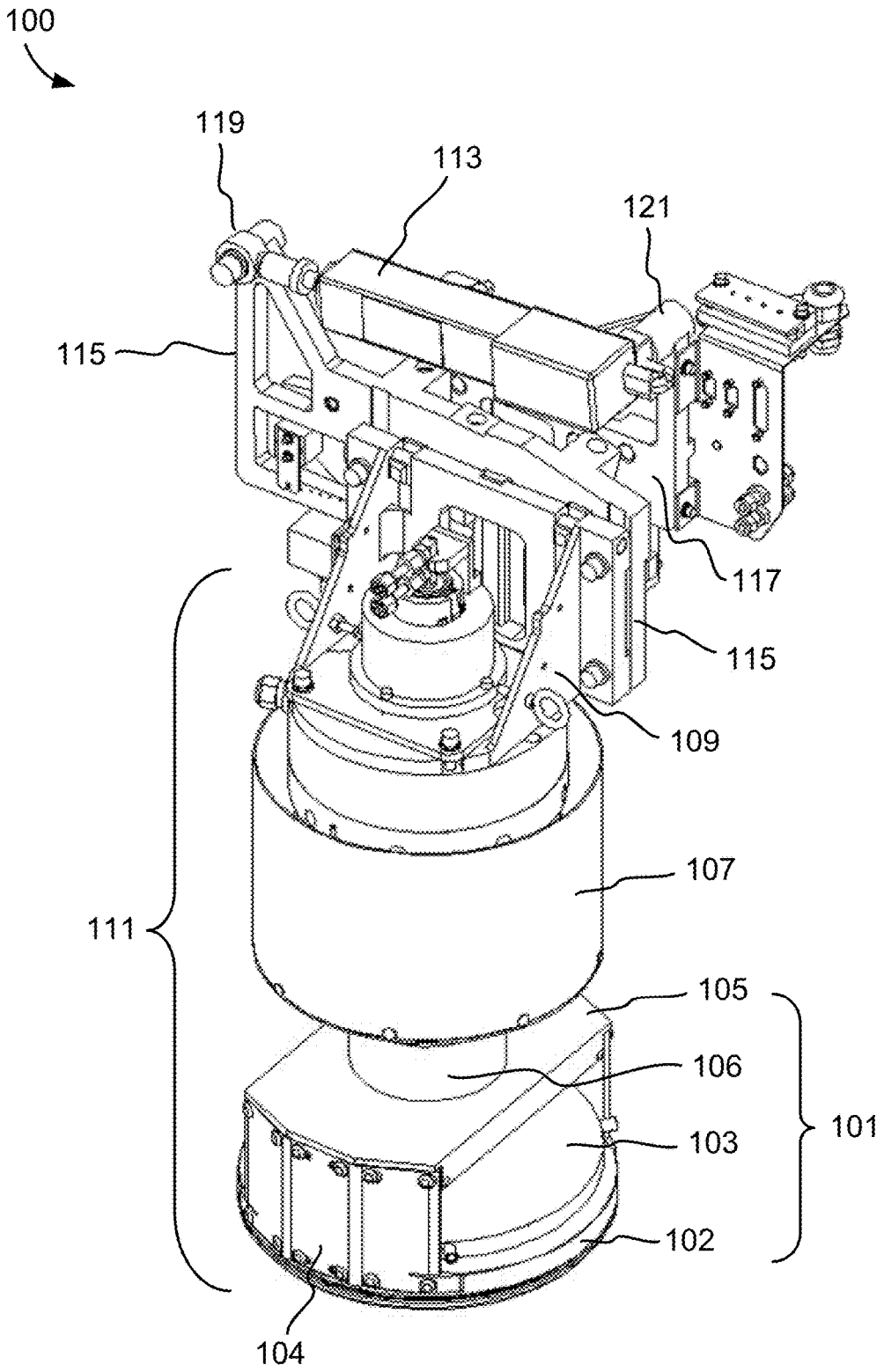
FIG. 1B shows a perspective view of a substrate holding and positioning apparatus for electrochemically treating semiconductor wafers.

The following description of FIG. 1B provides a general non-limiting context to assist in understanding the apparatus and methods described herein. FIG. 1B provides a perspective view of a wafer holding and positioning apparatus 100 for electrochemically treating semiconductor wafers. Apparatus 100 includes wafer engaging components (sometimes referred to herein as "clamshell" components). The actual clamshell includes a cup 102 and a cone 103 that enables pressure to be applied between the wafer and the seal, thereby securing the wafer in the cup.

Cup 102 is supported by struts 104, which are connected to a top plate 105. This assembly (102-105), collectively assembly 101, is driven by a motor 107, via a spindle 106. Motor 107 is attached to a mounting bracket 109. Spindle 106 transmits torque to a wafer (not shown in this figure) to allow rotation during plating. An air cylinder (not shown) within spindle 106 also provides vertical force between the cup and cone 103 to create a seal between the wafer and a sealing member (lipseal) housed within the cup. For the purposes of this discussion, the assembly including components 102-109 is collectively referred to as a wafer holder 111. Note however, that the concept of a "wafer holder" extends generally to various combinations and sub-combinations of components that engage a wafer and allow its movement and positioning.

A tilting assembly including a first plate 115, that is slidably connected to a second plate 117, is connected to mounting bracket 109. A drive cylinder 113 is connected both to plate 115 and plate 117 at pivot joints 119 and 121, respectively. Thus, drive cylinder 113 provides force for sliding plate 115 (and thus wafer holder 111) across plate 117. The distal end of wafer holder 111 (i.e. mounting bracket 109) is moved along an arced path (not shown) which defines the contact region between plates 115 and 117, and thus the proximal end of wafer holder 111 (i.e. cup and cone assembly) is tilted upon a virtual pivot. This allows for angled entry of a wafer into a plating bath.

The entire apparatus 100 is lifted vertically either up or down to immerse the proximal end of wafer holder 111 into a plating solution via another actuator (not shown). Thus, a two-component positioning mechanism provides both vertical movement along a trajectory perpendicular to an electrolyte and a tilting movement allowing deviation from a horizontal orientation (parallel to electrolyte surface) for the wafer (angled-wafer immersion capability). A more detailed description of the movement capabilities and associated hardware of apparatus 100 is described in U.S. Pat. No. 6,551,487 filed May 31, 2001 and issued Apr. 22, 2003, which is herein incorporated by reference in its entirety.

Note that apparatus 100 is typically used with a particular plating cell having a plating chamber which houses an anode (e.g., a copper anode or a non-metal inert anode) and electrolyte. The plating cell may also include plumbing or plumbing connections for circulating electrolyte through the plating cell—and against the work piece being plated. It may also include membranes or other separators designed to maintain different electrolyte chemistries in an anode compartment and a cathode compartment. Means of transferring anolyte to the catholyte or to the main plating bath by physical means (e.g. direct pumping including values, or an overflow trough) may optionally also be supplied.

Figure 1C:
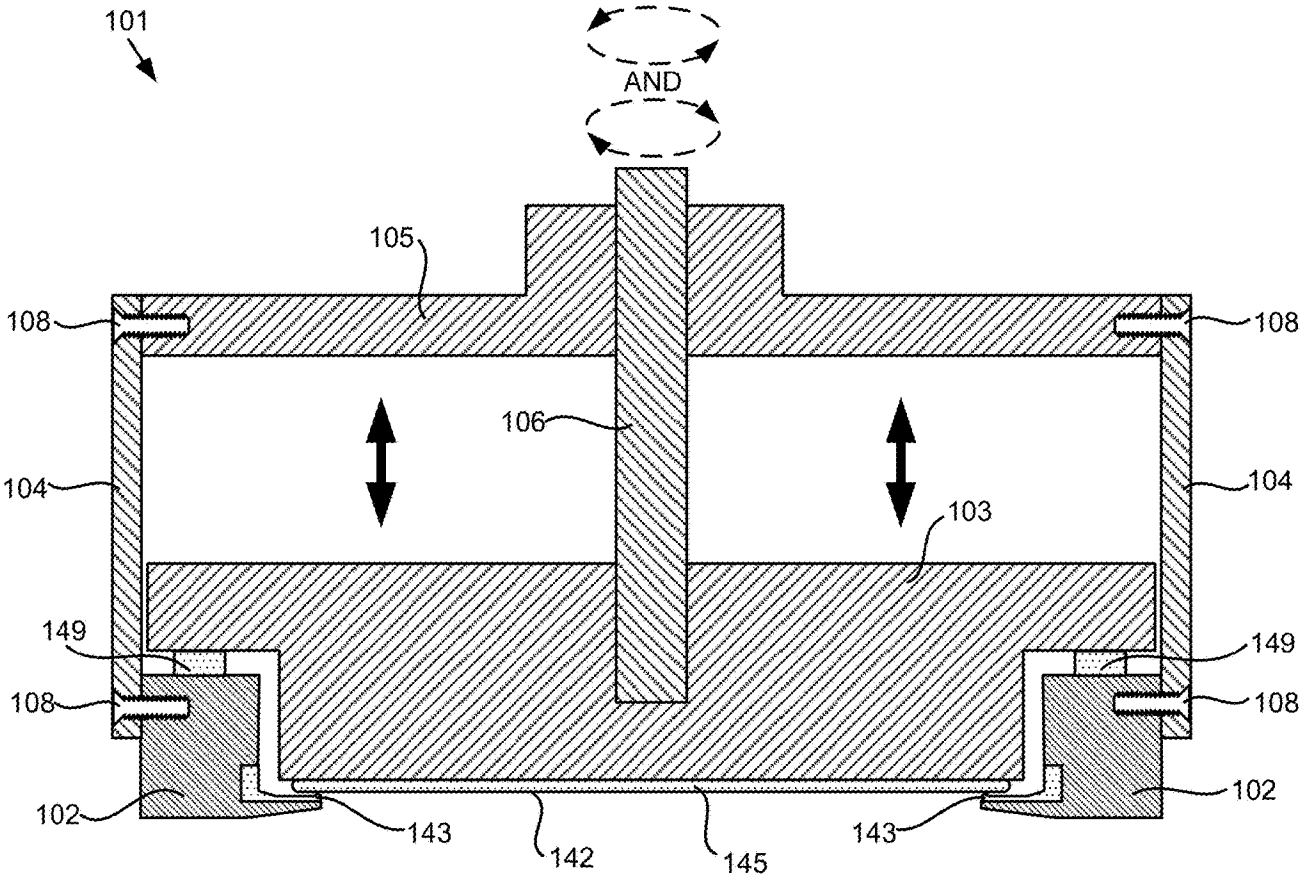
FIG. 1C depicts a cross sectional view of a portion of a substrate holding assembly including a cone and cup.

The following description provides more detail of the cup and cone assembly of the clamshell. FIG. 1C depicts a portion, 101, of assembly 100, including cone 103 and cup 102 in cross section format. Note that this figure is not meant to be a true depiction of a cup and cone product assembly, but rather a stylized depiction for discussion purposes. Cup 102 is supported by top plate 105 via struts 104, which are attached via screws 108. Generally, cup 102 provides a support upon which wafer 145 rests. It includes an opening through which electrolyte from a plating cell can contact the wafer. Note that wafer 145 has a front side 142, which is where plating occurs. The periphery of wafer 145 rests on the cup 102. The cone 103 presses down on the back side of the wafer to hold it in place during plating.

To load a wafer into 101, cone 103 is lifted from its depicted position via spindle 106 until cone 103 touches top plate 105. From this position, a gap is created between the cup and the cone into which wafer 145 can be inserted, and thus loaded into the cup. Then cone 103 is lowered to engage the wafer against the periphery of cup 102 as depicted, and mate to a set of electrical contacts (not shown in 1C) radially beyond the lip seal 143 along the wafer's outer periphery. In embodiments where a step or series of protuberances is used on a channeled ionically resistive plate (CIRP), the wafer may be inserted somewhat differently in order to avoid contacting the wafer or wafer holder with the CIRP. In this case, the wafer holder may initially insert the wafer at an angle relative to the surface of the electrolyte. Next, the wafer holder may rotate the wafer such that it is in a horizontal position. While the wafer is rotating, it may continue traveling downwards into the electrolyte, so long as the CIRP is not disturbed. A final portion of the wafer insertion may include inserting the wafer straight down. This straight down movement may be done once the wafer is in its horizontal orientation (i.e., after the wafer has been un-tilted).

Spindle 106 transmits both vertical force for causing cone 103 to engage a wafer 145 and torque for rotating assembly 101. These transmitted forces are indicated by the arrows in FIG. 1C. Note that wafer plating typically occurs while the wafer is rotating (as indicated by the dashed arrows at the top of FIG. 1C).

Cup 102 has a compressible lip seal 143, which forms a fluid-tight seal when cone 103 engages wafer 145. The vertical force from the cone and wafer compresses lip seal 143 to form the fluid tight seal. The lip seal prevents electrolyte from contacting the backside of wafer 145 (where it could introduce contaminating species such as copper or tin ions directly into silicon) and from contacting sensitive components of apparatus 101. There may also be seals located between the interface of the cup and the wafer which form fluid-tight seals to further protect the backside of wafer 145 (not shown).

Cone 103 also includes a seal 149. As shown, seal 149 is located near the edge of cone 103 and an upper region of the cup when engaged. This also protects the backside of wafer 145 from any electrolyte that might enter the clamshell from above the cup. Seal 149 may be affixed to the cone or the cup, and may be a single seal or a multi-component seal.

Upon initiation of plating, cone 103 is raised above cup 102 and wafer 145 is introduced to assembly 102. When the wafer is initially introduced into cup 102—typically by a robot arm—its front side, 142, rests lightly on lip seal 143. During plating the assembly 101 rotates in order to aid in achieving uniform plating. In subsequent figures, assembly 101 is depicted in a more simplistic format and in relation to components for controlling the hydrodynamics of electrolyte at the wafer plating surface 142 during plating.

Figure 1D:
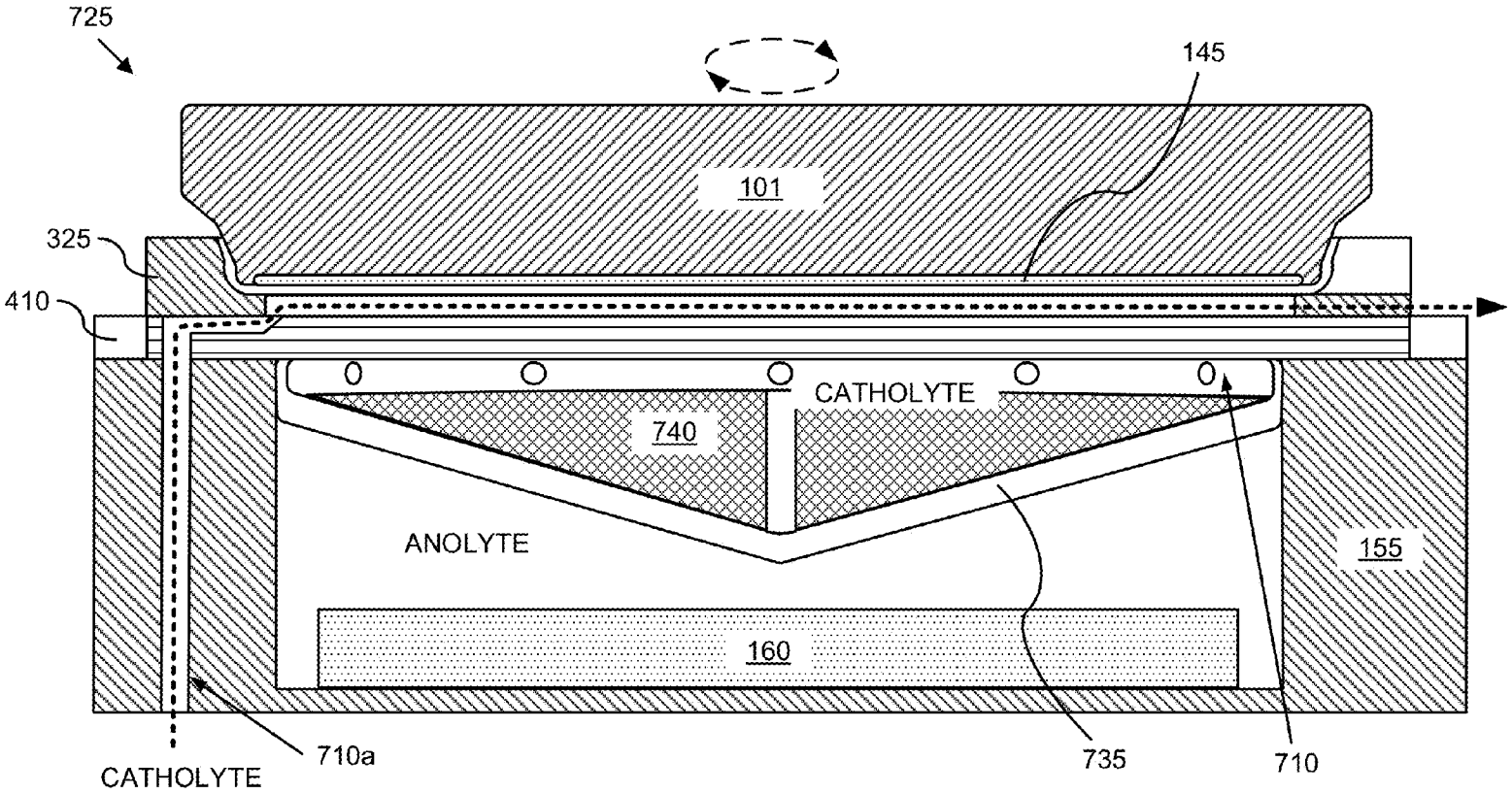
FIG. 1D depicts a simplified view of an electroplating cell that may be used in practicing the embodiments herein.

FIG. 1D depicts a cross section of a plating apparatus 725 for plating metal onto a wafer 145 which is held, positioned and rotated by wafer holder 101. Apparatus 725 includes a plating cell 155, which is dual chamber cell having an anode chamber with, for example, a copper anode, 160 and anolyte. The anode chamber and cathode chamber are separated by, for example, a cationic membrane 740 which is supported by a support member 735. Plating apparatus 725 includes a CIRP 410, as described herein. A flow diverter 325 is on top of the CIRP 410, and aides in creating transverse shear flow as described herein. Catholyte is introduced into the cathode chamber (above membrane 740) via flow ports 710. From flow ports 710, catholyte passes through CIRP 410 as described herein and produces impinging flow onto the plating surface of wafer 145. In addition to catholyte flow ports 710, an additional flow port 710*a* introduces catholyte at its exit at a position distal to the gap/outlet of flow diverter 325. In this example, flow port 710*a*'s exit is formed as a channel in flow shaping plate 410. The functional result is that catholyte flow is introduced directly into the plating region formed between the CIRP 410 and the wafer plating surface 145 in order to enhance transverse flow across the wafer surface and thereby normalize the flow vectors across the wafer 145 (and flow plate 410).

Figure 2:
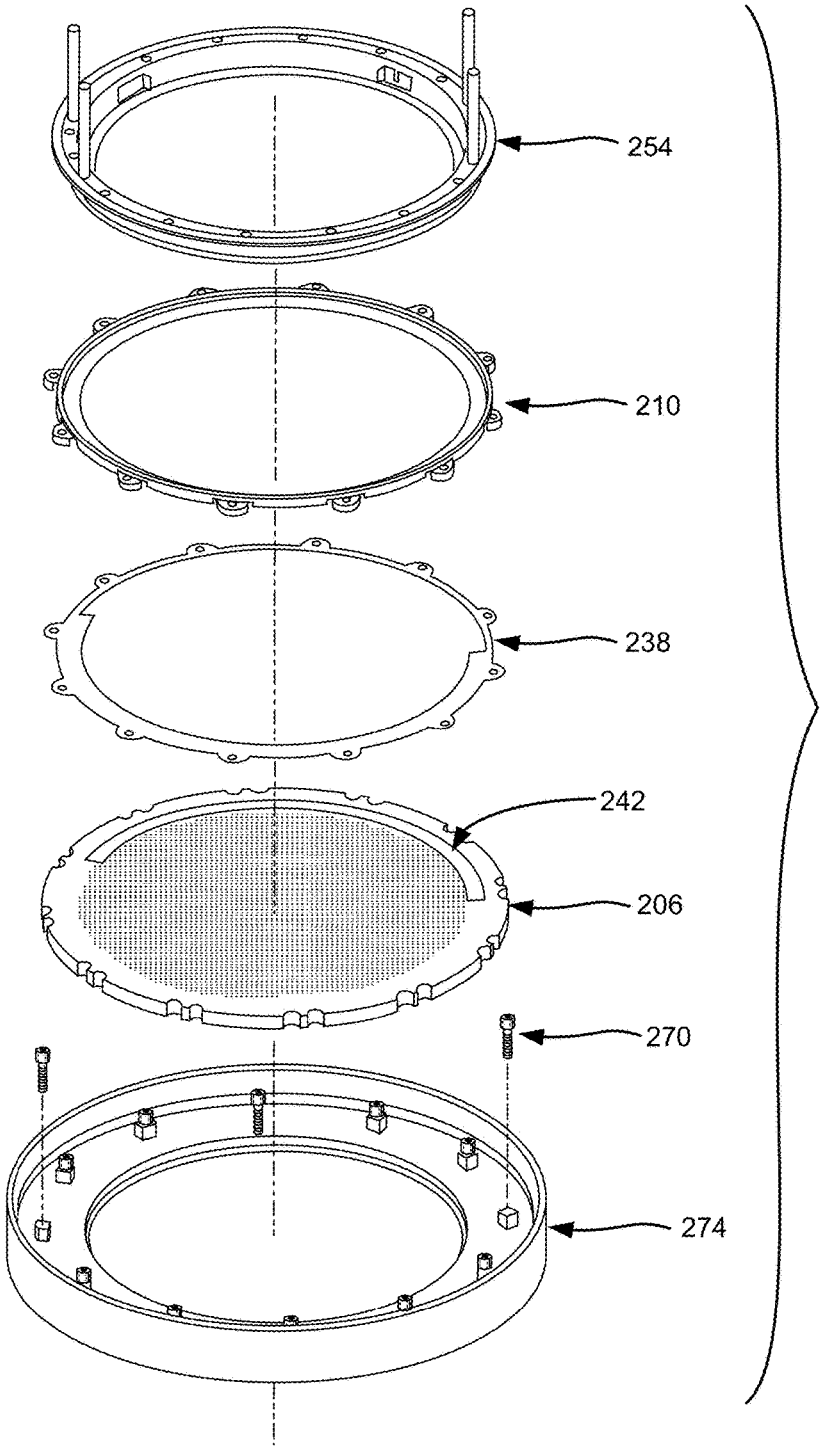
FIG. 2 illustrates an exploded view of various parts of an electroplating apparatus typically present in the cathode chamber in accordance with certain embodiments disclosed herein.

Numerous figures are provided to further illustrate and explain the embodiments disclosed herein. The figures include, among other things, various drawings of the structural elements and flow paths associated with a disclosed electroplating apparatus. These elements are given certain names/reference numbers, which are used consistently in describing FIGS. 2 through 19. FIG. 2 introduces several elements present in certain embodiments including a wafer holder 254, a cross flow confinement ring 210, a cross flow ring gasket 238, a channeled ionically resistive (CIRP) plate 206 with cross flow showerhead 242, and membrane frame 274 with fluidic adjustment rods 274. In FIG. 2, these elements are provided in an exploded view to demonstrate how these pieces fit together.

The following embodiments assume, for the most part, that the electroplating apparatus includes a separate anode chamber. The described features are contained in a cathode chamber. With respect to FIGS. 3A, 3B and 4, the bottom surface of the cathode chamber includes a membrane frame 274 and membrane 202 (n.b., because it is very thin, the membrane is not actually shown in the figures, but its location 202 is shown as being located at the lower surface of the membrane frame 274), that *separate* the anode chamber from the cathode chamber. Any number of possible anode and anode chamber configurations may be employed.

Much of the focus in the following description is on controlling the catholyte in the cross flow manifold or manifold region 226. This cross flow manifold region 226 may also be referred to as a gap or CIRP to wafer gap 226. The catholyte enters the cross flow manifold 226 through two separate entry points: (1) the channels in the channeled ionically resistive plate 206 and (2) cross flow initiating structure 250. The catholyte arriving in the cross flow manifold 226 via the channels in the CIRP 206 is directed toward the face of the work piece, typically in a substantially perpendicular direction. Such channel-delivered catholyte may form small jets that impinge on the face of the work piece, which is typically rotating slowly (e.g., between about 1 to 30 rpm) with respect to the channeled plate 206. The catholyte arriving in the cross flow manifold 226 via the cross flow initiating structure 250 is, in contrast, directed substantially parallel to the face of the work piece.

As indicated in the discussion above, a channeled ionically resistive plate 206 (sometimes also referred to as a channeled ionically resistive element, CIRP, high resistance virtual anode, or HRVA) is positioned between the working electrode (the wafer or substrate) and the counter electrode (the anode) during plating, in order to exhibit a large localized ionic system resistance relatively near the wafer interface (and thereby control and shape the electric field), and to control electrolyte flow characteristics. Various figures herein show the relative position of the channeled ionically resistive plate 206 with respect to other structural features of the disclosed apparatus. One example of such an ionically resistive element 206 is described in U.S. Pat. No. 8,308,931, filed Nov. 7, 2008, which was previously incorporated by reference herein in its entirety. The channeled ionically resistive plate described therein is suitable to improve radial plating uniformity on wafer surfaces such as those containing relatively low conductivity or those containing very thin resistive seed layers. In many embodiments, the channeled ionically resistive plate is adapted to include a step or a series of protuberances as mentioned above and further described below.

A "membrane frame" 274 (sometimes referred to as an anode membrane frame in other documents) is a structural element employed in some embodiments to support a membrane 202 that separates an anode chamber from a cathode chamber. It may have other features relevant to certain embodiments disclosed herein. Particularly, with reference to the embodiments of the figures, it may include flow channels 258 and 262 for delivering catholyte to a CIRP manifold 208 or to a cross flow manifold 226. Further, the membrane frame 274 may include showerhead plate 242 configured to deliver cross flowing catholyte to the cross flow manifold 226. The membrane frame 274 may also contain a cell weir wall 282, which is useful in determining and regulating the uppermost level of the catholyte. Various figures herein depict the membrane frame 274 in the context of other structural features associated with the disclosed cross flow apparatus.

The membrane frame 274 is a rigid structural member for holding a membrane 202 that is typically an ion exchange membrane responsible for separating an anode chamber from a cathode chamber. As explained, the anode chamber may contain electrolyte of a first composition while the cathode chamber contains electrolyte of a second composition. The membrane frame 274 may also include a plurality of fluidic adjustment rods 270 (sometimes referred to as flow constricting elements) which may be used to help control fluid delivery to the channeled ionically resistive element 206. The membrane frame 274 defines the bottom-most portion of the cathode chamber and the uppermost portion of the anode chamber. The described components are all located on the work piece side of an electrochemical plating cell above the anode chamber and the anode chamber membrane 202. They can all be viewed as being part of a cathode chamber. It should be understood, however, that certain implementations of a cross flow injection apparatus do not employ a separated anode chamber, and hence a membrane frame 274 is not essential.

Located generally between the work piece and the membrane frame 274 is the channeled ionically resistive plate 206, as well as a cross flow ring gasket 238 and wafer cross flow confinement ring 210, which may each be affixed to the channeled ionically resistive plate 206. More specifically, the cross flow ring gasket 238 may be positioned directly atop the CIRP 206, and the wafer cross flow confinement ring 210 may be positioned over the cross flow ring gasket 238 and affixed to a top surface of the channeled ionically resistive plate 206, effectively sandwiching the gasket 238. Various figures herein show the cross flow confinement ring 210 arranged with respect to the channeled ionically resistive plate 206. Further, the CIRP 206 may include a step or series of protuberances as explained further below.

Figure 8A:
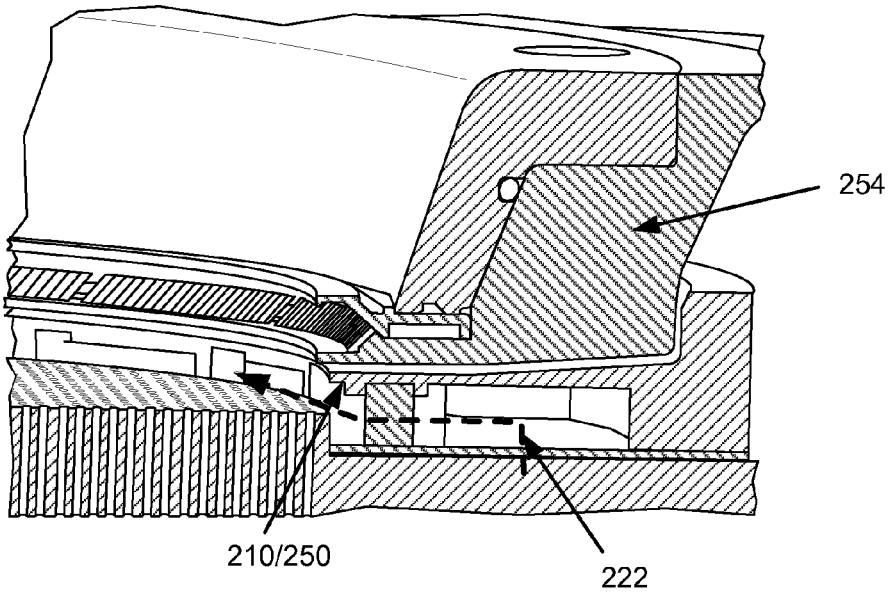
FIGS. 8A-8B depict designs of a cross flow inlet region according to certain embodiments.
Figure 8B:
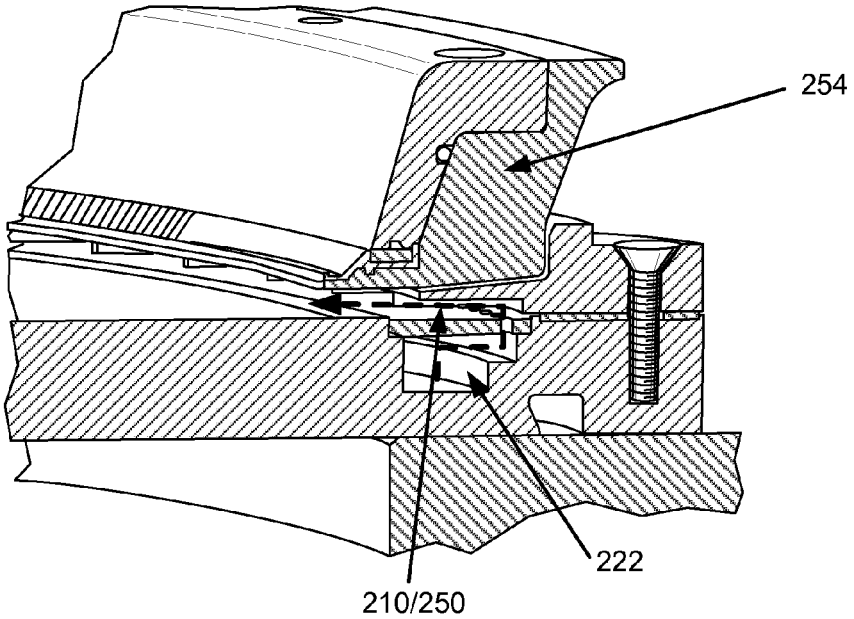

The upper most relevant structural feature of the present disclosure, as shown in FIG. 2, is a work piece or wafer holder. In certain embodiments, the work piece holder may be a cup 254, which is commonly used in cone and cup clamshell type designs such as the design embodied in the Sabre® electroplating tool mentioned above from Lam Research Corporation. FIGS. 2, 8A and 8B, for example, show the relative orientation of the cup 254 with respect to other elements of the apparatus.

Figure 3A:
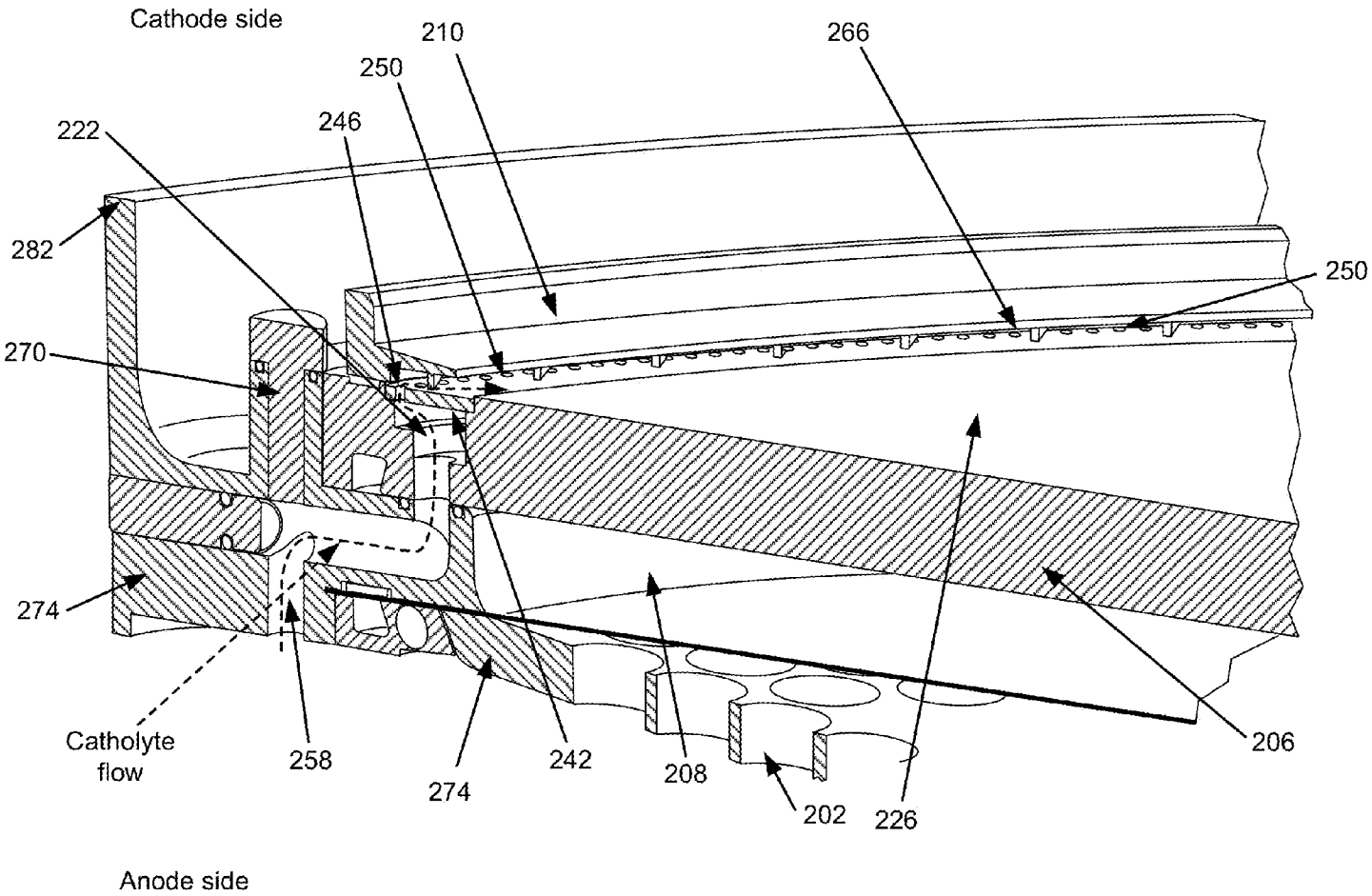
FIG. 3A shows a close-up view of a cross flow side inlet and surrounding hardware in accordance with certain embodiments herein.
Figure 3B:
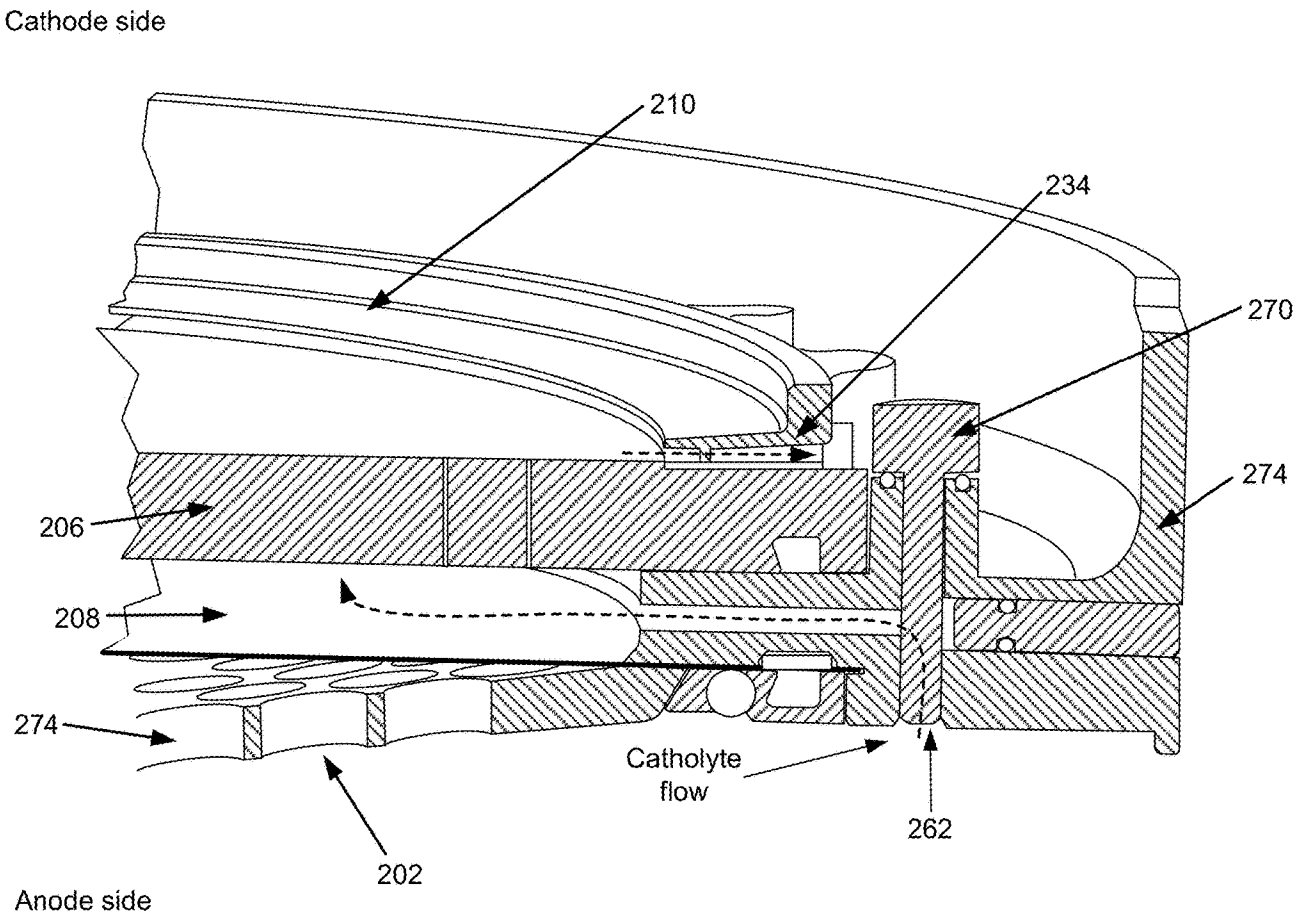
FIG. 3B shows a close-up view of a cross flow outlet, a CIRP manifold inlet, and surrounding hardware in accordance with various disclosed embodiments.
Figure 4:
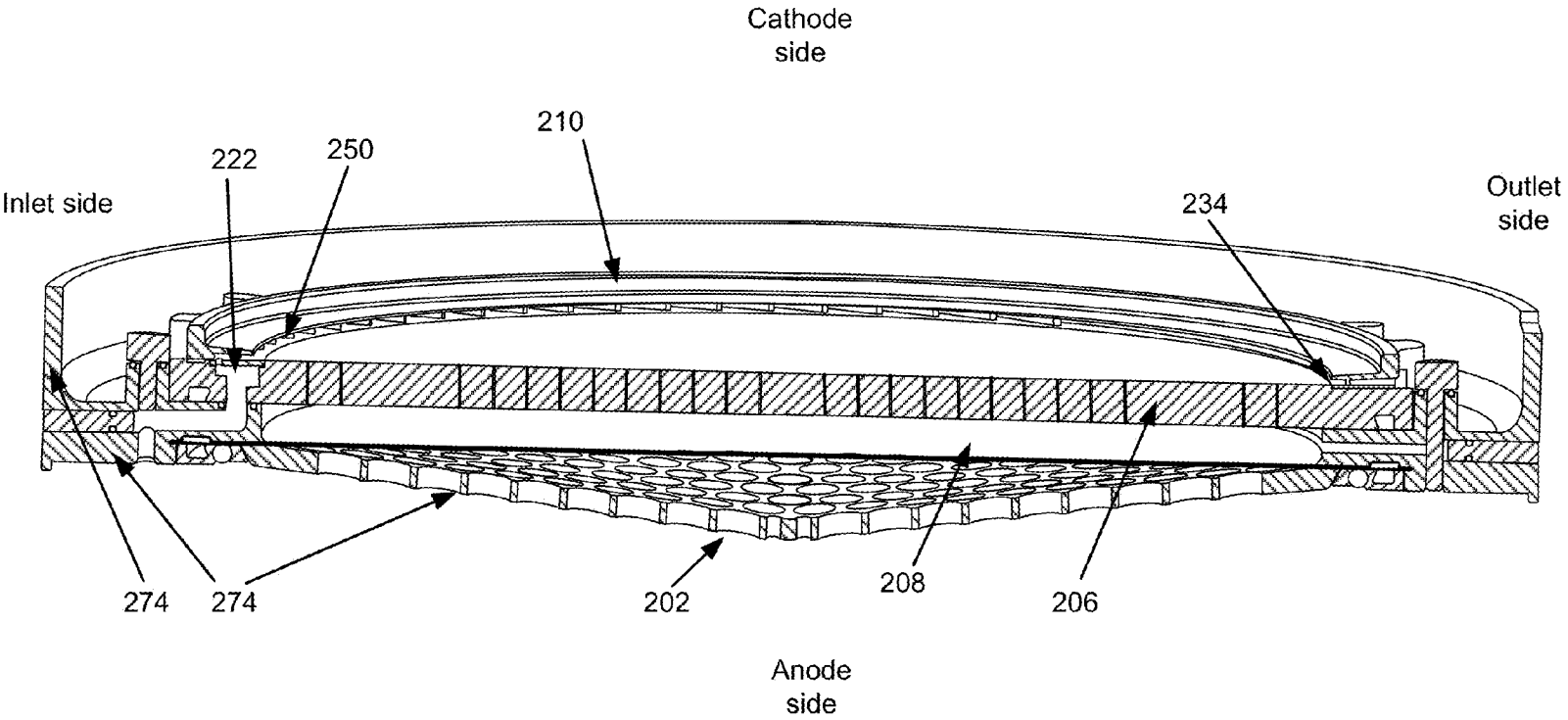
FIG. 4 depicts a cross sectional view of various parts of the electroplating apparatus shown in FIGS. 3A-B.

FIG. 3A shows a close-up cross sectional view of a cross flow inlet side of an electroplating apparatus according to an embodiment disclosed herein. FIG. 3B shows a close-up cross sectional view of the cross flow outlet side of the electroplating apparatus according to an embodiment herein. FIG. 4 shows a cross sectional view of a plating apparatus showing both the inlet and outlet sides, in accordance with certain embodiments herein. During a plating process, catholyte fills and occupies the region between the top of the membrane 202 on the membrane frame 274 and the membrane frame weir wall 282. This catholyte region can be subdivided into three sub-regions: 1) a channeled ionically resistive plate manifold region 208 below the CIRP 206 and (for designs employing an anode chamber cationic membrane) above the separated-anode-chamber's cationic-membrane 202 (this element is also sometimes referred to as a lower manifold region 208), 2) the cross flow manifold region 226, between the wafer and the upper surface of the CIRP 206, and 3) an upper cell region or "electrolyte containment region" outside of the clamshell/cup 254 and inside the cell weir wall 282 (which is sometimes a physical part of the membrane frame 274). When the wafer is not immersed and the clamshell/cup 254 is not in the down position, the second region and third region are combined into a single region.

FIG. 3B shows a cross section of a single inlet hole feeding the CIRP manifold 208 through channel 262. The dotted line indicates the path of fluid flow.

The catholyte may be delivered to the electroplating cell at a central catholyte inlet manifold (not shown), which may be located at the base of the cell and fed by a single pipe. From here, the catholyte may be separated into two different flow paths or streams. One stream (e.g., 6 of the 12 feeder holes) flows catholyte through channels 262 into the CIRP manifold region 208. After the catholyte is delivered to the CIRP manifold 208, it passes up through the microchannels in the CIRP and into the cross flow manifold 226. The other stream (e.g., the other 6 feeder holes) flows catholyte into the cross flow injection manifold 222. From here, the electrolyte passes through the distribution holes 246 (which may number more than about 100 in certain embodiments) of the cross flow showerhead 242. After leaving the cross flow showerhead holes 246, the catholyte's flow direction changes from (a) normal to the wafer to (b) parallel to the wafer. This change in flow direction occurs as the flow impinges upon and is confined by a surface in the cross flow confinement ring 210 inlet cavity 250. Finally, upon entering the cross flow manifold region 226, the two catholyte flows, initially separated at the base of the cell in the central catholyte inlet manifold, are rejoined.

In the embodiments shown in FIGS. 3A, 3B and 4, a fraction of the catholyte entering the cathode chamber is provided directly to the channeled ionically resistive plate manifold 208 and a portion is provided directly to the cross flow injection manifold 222. At least some (and often but not always all) of the catholyte delivered to the channeled ionically resistive plate manifold 208 passes through the various microchannels in the plate 206 and reaches the cross flow manifold 226. The catholyte entering the cross flow manifold 226 through the channels in the channeled ionically resistive plate 206 enters the cross flow manifold as substantially vertically directed jets (in some embodiments the channels are made at an angle, so they are not perfectly normal to the surface of the wafer, e.g., the angle of the jet may be up to about 45 degrees with respect to the wafer surface normal). The portion of the catholyte that enters the cross flow injection manifold 222 is delivered directly to the cross flow manifold 226 where it enters as a horizontally oriented cross flow below the wafer. On its way to the cross flow manifold 226, the cross flowing catholyte passes through the cross flow injection manifold 222 and the cross flow showerhead plate 242 (which, in a particular embodiment, contains about 139 distributed holes 246 having a diameter of about 0.048"), and is then redirected from a vertically upwards flow to a flow parallel to the wafer surface by the actions/geometry of the cross flow confinement ring's 210 entrance cavity 250.

The absolute angles of the cross flow and the jets need not be exactly horizontal or exactly vertical or even oriented at exactly 90° with one another. In general, however, the cross flow of catholyte in the cross flow manifold 226 is generally along the direction of the work piece surface and the direction of the jets of catholyte emanating from the top surface of the microchanneled ionically resistive plate 206 generally flow towards/perpendicular to the surface of the work piece. This mixture of cross flow and impinging flow on the wafer surface helps promote more uniform plating results. In certain embodiments, protuberances are used to help disturb cross flowing electrolyte such that it is redirected in a direction toward the wafer surface.

As mentioned, the catholyte entering the cathode chamber is divided between (i) catholyte that flows from the channeled ionically resistive plate manifold 208, through the channels in the CIRP 206 and then into the cross flow manifold 226 and (ii) catholyte that flows into the cross flow injection manifold 222, through the holes 246 in the showerhead 242, and then into the cross flow manifold 226. The flow directly entering from the cross flow injection manifold region 222 may enter via the cross flow confinement ring entrance ports, sometimes referred to as cross flow side inlets 250, and emanate parallel to the wafer and from one side of the cell. In contrast, the jets of fluid entering the cross flow manifold region 226 via the microchannels of the CIRP 206 enter from below the wafer and below the cross flow manifold 226, and the jetting fluid is diverted (redirected) within the cross flow manifold 226 to flow parallel to the wafer and towards the cross flow confinement ring exit port 234, sometimes also referred to as the cross flow outlet or outlet.

In a specific embodiment, there are six separate feed channels 258 for delivering catholyte directly to the cross flow injection manifold 222 (where it is then delivered to the cross flow manifold 226). In order to effect cross flow in the cross flow manifold 226, these channels 258 exit into the cross flow manifold 226 in an azimuthally non-uniform manner. Specifically, they enter the cross flow manifold 226 at a particular side or azimuthal region (e.g., the inlet side) of the cross flow manifold 226.

In a specific embodiment depicted in FIG. 3A, the fluid paths 258 for directly delivering catholyte to the cross flow injection manifold 222 pass through four separate elements before reaching the cross flow injection manifold 222: (1) dedicated channels in the cell's anode chamber wall, (2) dedicated channels in the membrane frame 274, (3) dedicated channels the channeled ionically resistive element 206 (these dedicated channels being distinct from the 1-D microchannels used for delivering catholyte from the CIRP manifold 208 to the cross flow manifold 226), and finally, (4) fluid paths in the wafer cross flow confinement ring 210. Where these elements are constructed differently, the catholyte may not flow through each of these separate elements.

As mentioned, the portions of the flow paths passing through the membrane frame 274 and feeding the cross flow injection manifold 222 are referred to as cross flow feed channels 258 in the membrane frame. Similarly, the portions of the flow paths passing through the membrane frame 274 and feeding the CIRP manifold are referred to as cross flow feed channels 262 feeding the channeled ionically resistive plate manifold 208, or CIRP manifold feed channels 262. In other words, the term "cross flow feed channel" includes both the catholyte feed channels 258 feeding the cross flow injection manifold 222 and the catholyte feed channels 262 feeding the CIRP manifold 208. One difference between these flows 258 and 262 was noted above: the direction of the flow through the CIRP 206 is initially directed at the wafer and is then turned parallel to the wafer due to the presence of the wafer and the cross flow in the cross flow manifold, whereas the cross flow portion coming from the cross flow injection manifold 222 and out through the cross flow confinement ring entrance ports 250 starts substantially parallel to the wafer in the cross flow manifold. While not wishing to be held to any particular model or theory, this combination and mixing of impinging and parallel flow is believed to facilitate substantially improved flow penetration within a recessed/embedded feature and thereby improve the mass transfer. The inclusion of a series of protuberances on the CIRP surface can further enhance such mixing. By creating a spatially uniform convective flow field under the wafer and rotating the wafer, each feature, and each die, exhibits a nearly identical flow pattern over the course of the rotation and the plating process.

Figure 5:
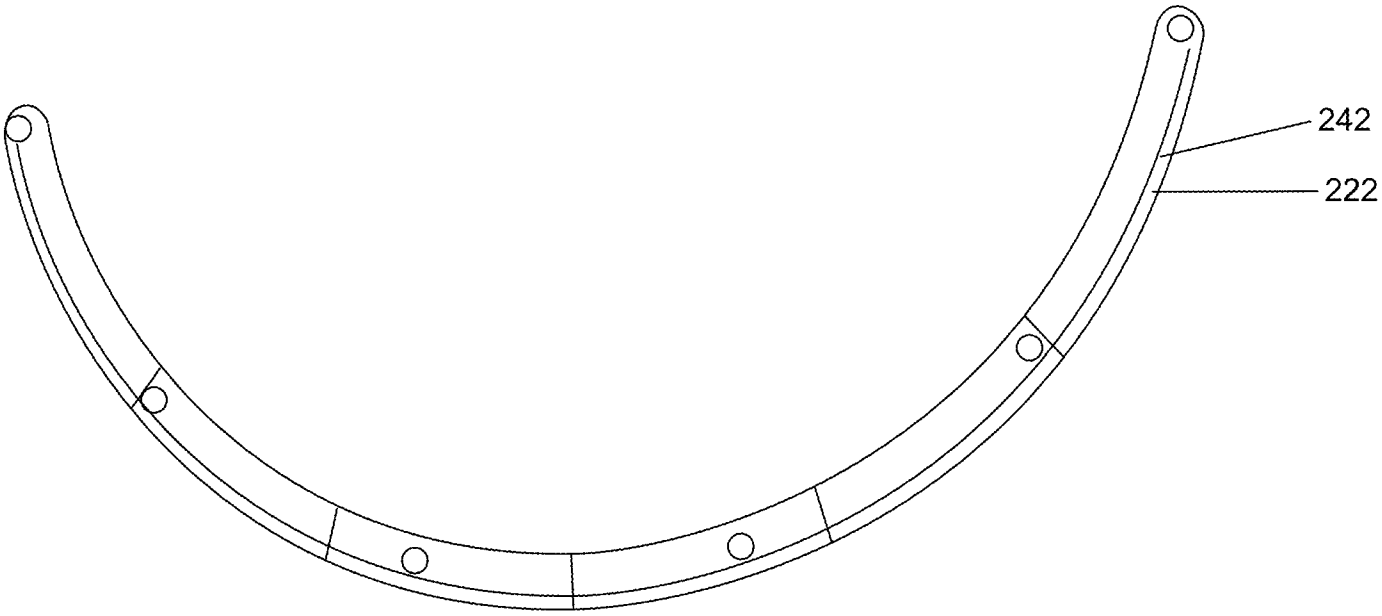
FIG. 5 shows a cross flow injection manifold and showerhead split into 6 individual segments according to certain embodiments.
Figure 6:
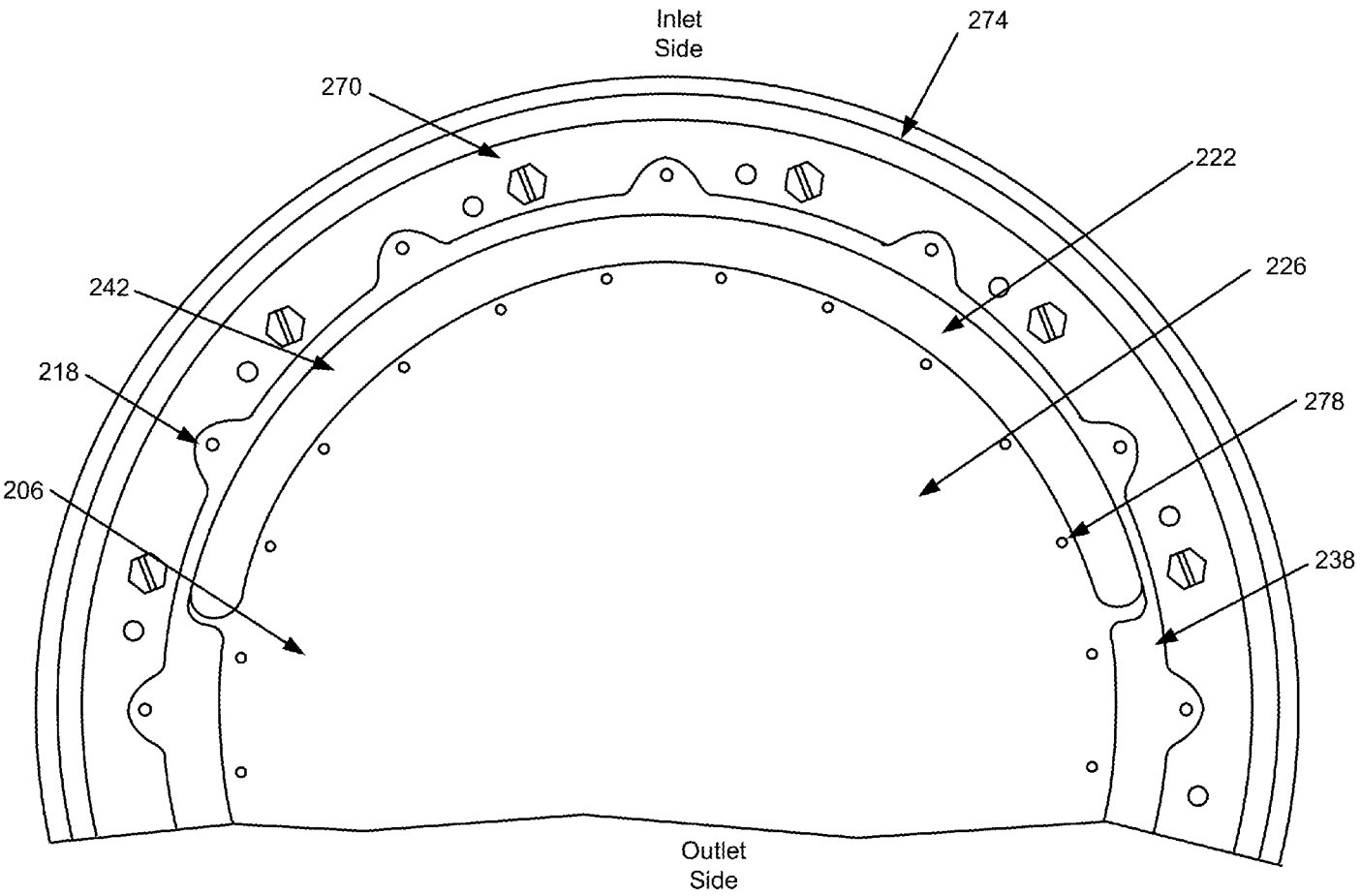
FIG. 6 shows a top view of a CIRP and associated hardware according to an embodiment herein, focusing especially on the inlet side of the cross flow.
Figure 7:
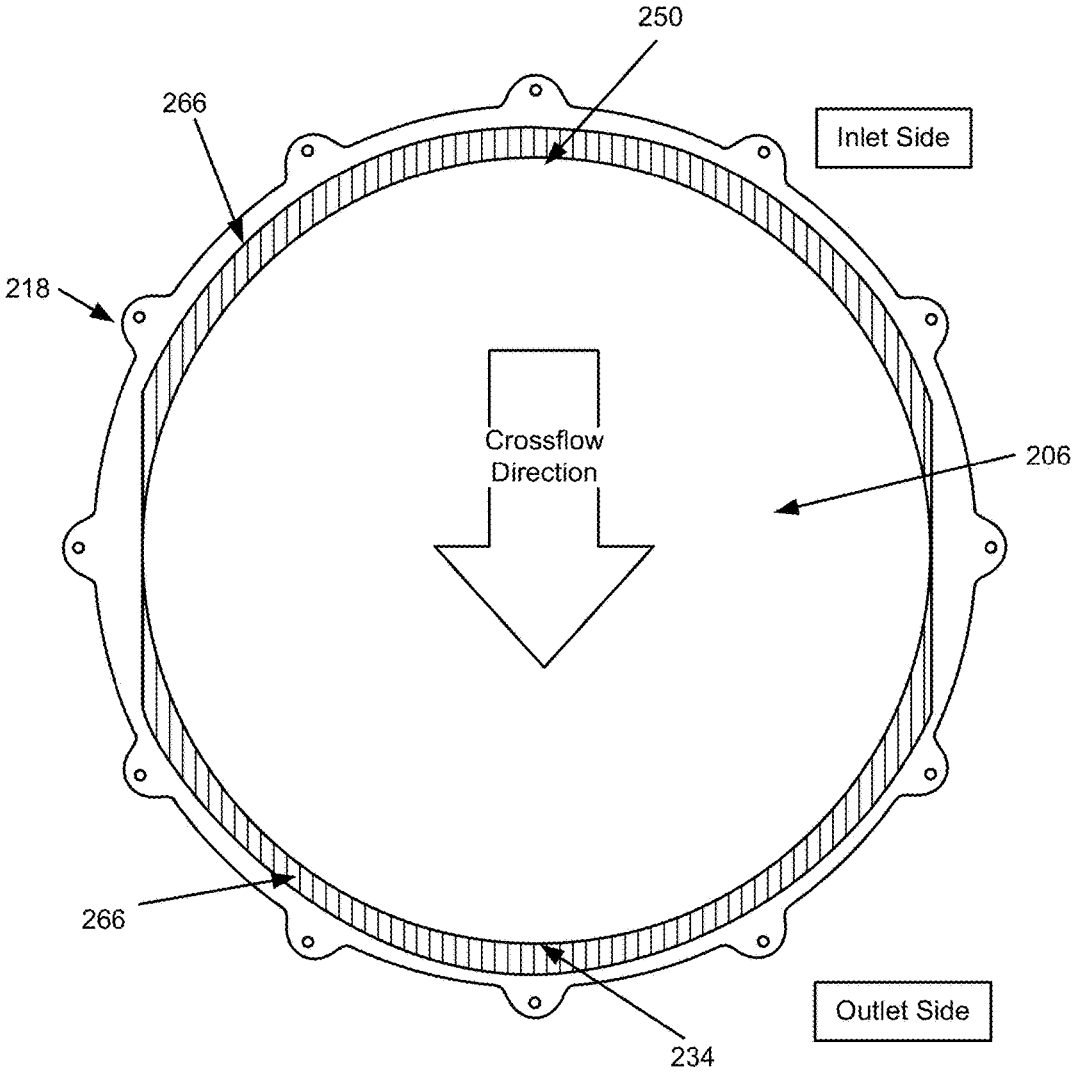
FIG. 7 illustrates a simplified top view of a CIRP and associated hardware showing both the inlet and outlet sides of the cross flow manifold according to various disclosed embodiments.

The flow path for delivering cross flowing electrolyte begins in a vertically upward direction as it passes through the cross flow feed channel 258 in the plate 206. Next, this flow path enters a cross flow injection manifold 222 formed within the body of the channeled ionically resistive plate 206. The cross flow injection manifold 222 is an azimuthal cavity which may be a dug out channel within the plate 206 that can distribute the fluid from the various individual feed channels 258 (e.g., from each of the 6 individual cross flow feed channels) to the various multiple flow distribution holes 246 of the cross flow showerhead plate 242. This cross flow injection manifold 222 is located along an angular section of the peripheral or edge region of the channeled ionically resistive plate 206. See for example FIGS. 3A and 4-6. FIGS. 3A and 4 were introduced above. FIG. 5 shows a showerhead plate 242 positioned over a cross flow injection manifold 222. FIG. 6 similarly shows showerhead plate 242 over the cross flow injection manifold 222, in the context of various other elements of the plating apparatus.

In certain embodiments, the cross flow injection manifold 222 forms a C-shaped structure over an angle of about 90-180° of the plate's perimeter region, as shown in FIGS. 5 and 6. In certain embodiments, the angular extent of the cross flow injection manifold 222 is about 120-170°, and in a more specific embodiment is between about 140-150°. In these or other embodiments, the angular extent of the cross flow injection manifold 222 is at least about 90°. In many implementations, the showerhead 242 spans approximately the same angular extent as the cross flow injection manifold 222. Further, the overall inlet structure 250 (which in many cases includes one or more of the cross flow injection manifold 222, the showerhead plate 242, the showerhead holes 246, and an opening in the cross flow confinement ring 210) may span these same angular extents.

In some embodiments, the cross flow in the injection manifold 222 forms a continuous fluidically coupled cavity within the channeled ionically resistive plate 206. In this case, all of the cross flow feed channels 258 feeding the cross flow injection manifold exit into one continuous and connected cross flow injection manifold chamber. In other embodiments, the cross flow injection manifold 222 and/or the cross flow showerhead 242 are divided into two or more angularly distinct and completely or partially separated segments, as shown in FIG. 5 (which shows 6 separated segments). In some embodiments, the number of angularly separated segments is between about 1-12, or between about 4-6. In a specific embodiment, each of these angularly distinct segments is fluidically coupled to a separate cross flow feed channel 258 disposed in the channeled ionically resistive plate 206. Thus, for example, there may be six angularly distinct and separated subregions within the cross flow injection manifold 222, each fed by a separate cross flow feed channel 258. In certain embodiments, each of these distinct subregions of the cross flow injection manifold 222 has the same volume and/or the same angular extent.

In many cases, catholyte exits the cross flow injection manifold 222 and passes through a cross flow showerhead plate 242 having many angularly separated catholyte outlet ports (holes) 246. See for example FIGS. 2, 3A and 6 (the catholyte outlet ports/holes 246 are not shown in all figures). In certain embodiments, the cross flow showerhead plate 242 is integrated into the channeled ionically resistive plate 206, as shown in FIG. 6 for example. In some embodiments the showerhead plate 242 is glued, bolted, or otherwise affixed to the top of the cross flow injection manifold 222 of the channeled ionically resistive plate 206. In certain embodiments, the top surface of the cross flow showerhead 242 is flush with or slightly elevated above a plane or top surface of the channeled ionically resistive plate 206 (excluding any step or protuberances on the CIRP 206). In this manner, catholyte flowing through the cross flow injection manifold 222 may initially travel vertically upward through the showerhead holes 246 and then laterally under the cross flow confinement ring 210 and into the cross flow manifold 226 such that the catholyte enters the cross flow manifold 226 in a direction that is substantially parallel with the surface of a wafer. In other embodiments, the showerhead 242 may be oriented such that catholyte exiting the showerhead holes 246 is already traveling in a wafer-parallel direction.

In a specific embodiment, the cross flow showerhead 242 has about 140 angularly separated catholyte outlet holes 246. More generally, any number of holes that reasonably establish uniform cross flow within the cross flow manifold 226 may be employed. In certain embodiments, there are between about 50-300 such catholyte outlet holes 246 in the cross flow showerhead 242. In certain embodiments, there are between about 100-200 such holes. In certain embodiments, there are between about 120-160 such holes. Generally, the size of the individual ports or holes 246 can range from about 0.020-0.10 inches, more specifically from about 0.03-0.06 inches in diameter.

In certain embodiments, these holes 246 are disposed along the entire angular extent of the cross flow showerhead 242 in an angularly uniform manner (i.e., the spacing between the holes 246 is determined by a fixed angle between the cell center and two adjacent holes). In other embodiments, the holes 246 are distributed along the angular extent in an angularly non-uniform manner. In certain embodiments, the angularly non-uniform hole distribution is nevertheless a linearly ("x-direction") uniform distribution. Put another way, in this latter case, the hole distribution is such that the holes are spaced equally far apart if projected onto an axis perpendicular to the direction of cross flow (this axis is the "x" direction). Each hole 246 is positioned at the same radial distance from the cell center, and is spaced the same distance in the "x" direction from adjacent holes. The net effect of having these angularly non-uniform holes 246 is that the overall cross flow pattern is much more uniform. In contrast, where the holes are spaced in an angularly uniform manner, the cross flow over the center portion of the substrate will be lower than the cross flow over the edge regions, since the edge regions will have more holes than are needed for uniform cross flow.

In certain embodiments, the direction of the catholyte exiting the cross flow showerhead 242 is further controlled by a wafer cross flow confinement ring 210. In certain embodiments, this ring 210 extends over the full circumference of the channeled ionically resistive plate 206. In certain embodiments, a cross section of the cross flow confinement ring 210 has an L-shape, as shown in FIGS. 3A, 3B and 4. This shape may be chosen to match the bottom surface of a substrate holder/cup 254. In certain embodiments, the wafer cross flow confinement ring 210 contains a series of flow directing elements such as directional fins 266 in fluidic communication with the outlet holes 246 of the cross flow showerhead 242. The fins 266 are shown clearly in FIG. 7, but can also be seen in FIGS. 3A and 4. The directional fins 266 define largely segregated fluid passages under an upper surface of the wafer cross flow confinement ring 210 and between adjacent directional fins 266. In some cases, the purpose of the fins 266 is to redirect and confine flow exiting from the cross flow showerhead holes 246 from an otherwise radially inward direction to a "left to right" flow trajectory (left being the inlet side 250 of the cross flow, right being the outlet side 234). This helps to establish a substantially linear cross flow pattern. The catholyte exiting the holes 246 of the cross flow showerhead 242 is directed by the directional fins 266 along a flow streamline caused by the orientation of the directional fins 266. In certain embodiments, all the directional fins 266 of the wafer cross flow confinement ring 210 are parallel to one another. This parallel arrangement helps to establish a uniform cross flow direction within the cross flow manifold 226. In various embodiments, the directional fins 266 of the wafer cross flow confinement ring 210 are disposed both along the inlet 250 and outlet 234 side of the cross flow manifold 226. In other cases, the fins 266 may be disposed only along the inlet region 250 of the cross flow manifold 226.

As indicated, catholyte flowing in the cross flow manifold 226 passes from an inlet region 250 of the wafer cross flow confinement ring 210 to an outlet side 234 of the ring 210, as shown in FIGS. 3B and 4. At the outlet side 234, in certain embodiments, there are multiple directional fins 266 that may be parallel to and may align with the directional fins 266 on the inlet side. The cross flow passes through channels created by the directional fins 266 on the outlet side 234 and then out of the cross flow manifold 226. The flow then passes into another region of the cathode chamber generally radially outwards and beyond the wafer holder 254 and cross flow confinement ring 210, with fluid collected and temporarily retained by the upper weir wall 282 of the membrane frame before flowing over the weir 282 for collection and recirculation. It should therefore be understood that the figures (e.g., FIGS. 3A, 3B and 4) show only a partial path of the entire circuit of catholyte entering and exiting the cross flow manifold. Note that, in the embodiment depicted in FIGS. 3B and 4, for example, fluid exiting from the cross flow manifold 226 does not pass through small holes or back through channels analogous to the feed channels 258 on the inlet side, but rather passes outward in a generally parallel-to-the wafer direction as it is accumulated in the aforementioned accumulation region.

Returning to the embodiment of FIG. 6, a top view looking down into the cross flow manifold 226 is shown. This figure depicts the location of an embedded cross flow injection manifold 222 within the channeled ionically resistive plate 206, along with the showerhead 242. While the outlet holes 246 on the showerhead 242 are not shown, it is understood that such outlet holes are present. The fluidic adjustment rods 270 for the cross flow injection manifold flow are also shown. The cross flow confinement ring 210 is not installed in this depiction, but the outline of the cross flow confinement ring sealing gasket 238, which seals between the cross flow confinement ring 210 and the upper surface of the CIRP 206, is shown. Other elements which are shown in FIG. 6 include the cross flow confinement ring fasteners 218, membrane frame 274, and screw holes 278 on the anode side of the CIRP 206 (which may be used for a cathodic shielding insert, for example).

In some embodiments, the geometry of the cross flow confinement ring outlet 234 may be tuned in order to further optimize the cross flow pattern. For example, a case in which the cross flow pattern diverges to the edge of the confinement ring 210 may be corrected by reducing the open area in the outer regions of the cross flow confinement ring outlet 234. In certain embodiments, the outlet manifold 234 may include separated sections or ports, much like the cross flow injection manifold 222. In some embodiments, the number of outlet sections is between about 1-12, or between about 4-6. The ports are azimuthally separated, occupying different (usually adjacent) positions along the outlet manifold 234. The relative flow rates through each of the ports may be independently controlled in some cases. This control may be achieved, for example, by using control rods 270 similar to the control rods described in relation to the inlet flow. In another embodiment, the flow through the different sections of the outlet can be controlled by the geometry of the outlet manifold. For example, an outlet manifold that has less open area near each side edge and more open area near the center would result in a solution flow pattern where more flow exits near the center of the outlet and less flow exits near the edges of the outlet. Other methods of controlling the relative flow rates through the ports in the outlet manifold 234 may be used as well (e.g., pumps, process control valves, etc.).

As mentioned, bulk catholyte entering the catholyte chamber is directed separately into the cross flow injection manifold 222 and the channeled ionically resistive plate manifold 208 through multiple channels 258 and 262. In certain embodiments, the flows through these individual channels 258 and 262 are independently controlled from one another by an appropriate mechanism. In some embodiments, this mechanism involves separate pumps for delivering fluid into the individual channels. In other embodiments, a single pump is used to feed a main catholyte manifold, and various flow restriction elements that are adjustable may be provided in one or more of the channels so as to modulate the relative flows between the various channels 258 and 262 and between the cross flow injection manifold 222 and CIRP manifold 208 regions and/or along the angular periphery of the cell. In various embodiments depicted in the figures, one or more fluidic adjustment rods 270 (sometimes also referred to as flow control elements) are deployed in the channels where independent control is provided. In the depicted embodiments, the fluidic adjustment rod 270 provides an annular space in which catholyte is constricted during its flow toward the cross flow injection manifold 222 or the channeled ionically resistive plate manifold 208. In a fully retracted state, the fluidic adjustment rod 270 provides essentially no resistance to flow. In a fully engaged state, the fluidic adjustment rod 270 provides maximal resistance to flow, and in some implementations stops all flow through the channel. In intermediate states or positions, the rod 270 allows intermediate levels of constriction of the flow as fluid flows through a restricted annular space between the channel's inner diameter and the fluid adjustment rod's outer diameter.

In some embodiments, the adjustment of the fluidic adjustment rods 270 allows the operator or controller of the electroplating cell to favor flow to either the cross flow injection manifold 222 or to the channeled ionically resistive plate manifold 208. In certain embodiments, independent adjustment of the fluidics adjustment rods 270 in the channels 258 that deliver catholyte directly to the cross flow injection manifold 222 allows the operator or controller to control the azimuthal component of fluid flow into the cross flow manifold 226.

FIGS. 8A-8B show cross sectional views of a cross flow injection manifold 222 and corresponding cross flow inlet 250 relative to a plating cup 254. The position of the cross flow inlet 250 is defined, at least in part, by the position of the cross flow confinement ring 210. Specifically, the inlet 250 may be considered to begin where the cross flow confinement ring 210 terminates. In FIG. 8A, the confinement ring 210 termination point (and inlet 250 commencement point) is under the edge of the wafer, whereas in FIG. 8B, the termination/commencement point is under the plating cup and further radially outward from the wafer edge, as compared to the design in FIG. 8A. Also, the cross flow injection manifold 222 in FIG. 8A has a step in the cross flow ring cavity (where the generally leftward arrow begins rising upwards) which may form some turbulence near that point of fluid entry into the cross flow manifold region 226. In certain cases, it may be beneficial to minimize the expansion of the fluid trajectories near the wafer edge and allow the plating solution to transition from the cross flow injection manifold region 222 and enter the cross flow manifold region 226 by providing some distance (e.g., about 10-15 mm) for the solution flow to become more uniform before flowing across the wafer surface.

Figure 9:
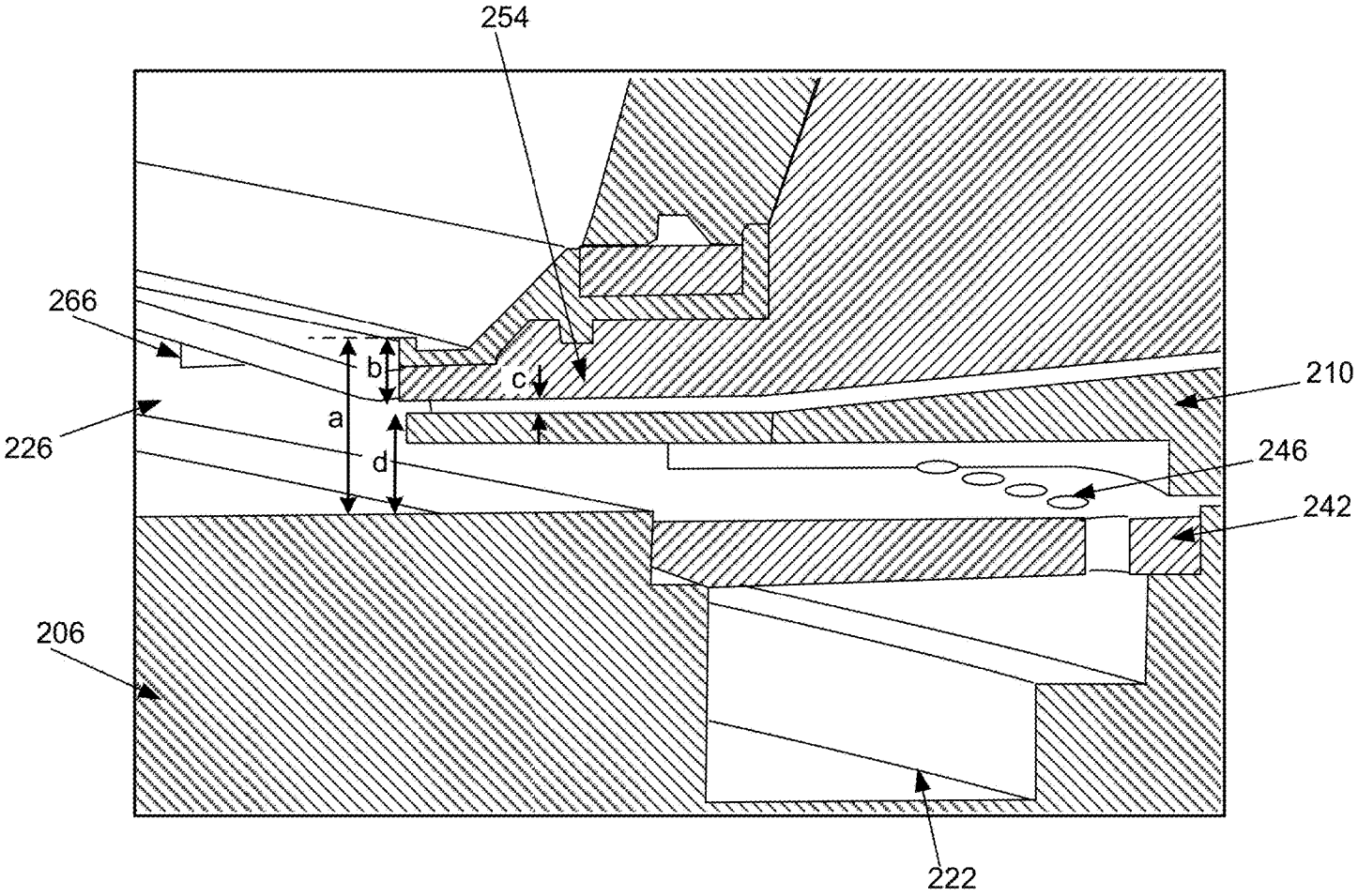
FIG. 9 shows a cross flow inlet region depicting certain relevant geometries.

FIG. 9 provides a close-up view of an inlet portion of a plating apparatus. This figure is provided to show the relative geometries of certain elements. Distance (a) represents the height of the cross flow manifold region 226. This is the distance between the top of the wafer holder (where the substrate sits) and the plane of the upper most surface of the CIRP 206. Because the CIRP 206 of FIG. 9 does not include a step or protuberances, the upper most surface of the CIRP 206 is also the CIRP plane, as defined herein. In certain embodiments, this distance is between about 2-10 mm, for example about 4.75 mm. Distance (b) represents the distance between the exposed wafer surface and the bottom-most surface of the wafer holder (the bottom surface of the wafer holding cup). In certain embodiments, this distance is between about 1-4 mm, for example about 1.75 mm. Distance (c) represents the height of a fluid gap between the upper surface of the cross flow confinement ring 210 and the bottom surface of a cup 254. This gap between the confinement ring 210 and the bottom of the cup 254 provides space to allow the cup 254 to rotate during plating, and is typically as small as possible to prevent fluid from leaking out that gap and thereby confine it inside the cross flow manifold region 226. In some embodiments, the fluid gap is about 0.5 mm tall. Distance (d) represents the height of the fluid channel for delivering cross flowing catholyte into the cross flow manifold 226. Distance (d) includes the height of the cross flow confinement ring 210. In certain embodiments, distance (d) is between about 1-4 mm, for example about 2.5 mm. Also shown in FIG. 9 are the cross flow injection manifold 222, the showerhead plate 242 with distribution holes 246, and one of the directional fins 266 attached to the cross flow confinement ring 210.

The disclosed apparatus may be configured to perform the methods described herein. A suitable apparatus includes hardware as described and shown herein and one or more controllers having instructions for controlling process operations in accordance with the present invention. The apparatus will include one or more controllers for controlling, inter alia, the positioning of the wafer in the cup 254 and cone, the positioning of the wafer with respect to the channeled ionically resistive plate 206, the rotation of the wafer, the delivery of catholyte into the cross flow manifold 226, delivery of catholyte into the CIRP manifold 208, delivery of catholyte into the cross flow injection manifold 222, the resistance/position of the fluidic adjustment rods 270, the delivery of current to the anode and wafer and any other electrodes, the mixing of electrolyte components, the timing of electrolyte delivery, inlet pressure, plating cell pressure, plating cell temperature, wafer temperature, and other parameters of a particular process performed by a process tool.

A system controller will typically include one or more memory devices and one or more processors configured to execute the instructions so that the apparatus will perform a method in accordance with the present invention. The processor may include a central processing unit (CPU) or computer, analog and/or digital input/output connections, stepper motor controller boards, and other like components. Machine-readable media containing instructions for controlling process operations in accordance with the present invention may be coupled to the system controller. Instructions for implementing appropriate control operations are executed on the processor. These instructions may be stored on the memory devices associated with the controller or they may be provided over a network. In certain embodiments, the system controller executes system control software . . . .

System control software may be configured in any suitable way. For example, various process tool component subroutines or control objects may be written to control operation of the process tool components necessary to carry out various process tool processes. System control software may be coded in any suitable computer readable programming language.

In some embodiments, system control software includes input/output control (IOC) sequencing instructions for controlling the various parameters described above. For example, each phase of an electroplating process may include one or more instructions for execution by the system controller. The instructions for setting process conditions for an immersion process phase may be included in a corresponding immersion recipe phase. In some embodiments, the electroplating recipe phases may be sequentially arranged, so that all instructions for an electroplating process phase are executed concurrently with that process phase.

Other computer software and/or programs may be employed in some embodiments. Examples of programs or sections of programs for this purpose include a substrate positioning program, an electrolyte composition control program, a pressure control program, a heater control program, and a potential/current power supply control program.

In some cases, the controllers control one or more of the following functions: wafer immersion (translation, tilt, rotation), fluid transfer between tanks, etc. The wafer immersion may be controlled by, for example, directing the wafer lift assembly, wafer tilt assembly and wafer rotation assembly to move as desired. The controller may control the fluid transfer between tanks by, for example, directing certain valves to be opened or closed and certain pumps to turn on and off. The controllers may control these aspects based on sensor output (e.g., when current, current density, potential, pressure, etc. reach a certain threshold), the timing of an operation (e.g., opening valves at certain times in a process) or based on received instructions from a user.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

Features of a Channeled Ionically Resistive Element

Electrical Function

In certain embodiments, the channeled ionically resistive element approximates a nearly constant and uniform current source in the proximity of the substrate (cathode) and, as such, may be referred to as a high resistance virtual anode (HRVA) in some contexts. Normally, the CIRP is placed in close proximity with respect to the wafer. In contrast, an anode in the same close-proximity to the substrate would be significantly less apt to supply a nearly constant current density to and across the wafer, but would merely support a constant potential plane at the anode metal surface, thereby allowing the current to be greatest where the net resistance from the anode plane to the terminus (e.g., to peripheral contact points on the wafer) is smaller. So while the channeled ionically resistive element has sometimes been referred to as a high-resistance virtual anode (HRVA), this does not imply that electrochemically the two are interchangeable. Under the best operational conditions, the CIRP would more closely approximate and perhaps be better described as a virtual uniform current source, with nearly constant current being sourced from across the upper plane of the CIRP. While the CIRP is certainly viewable as a "virtual current source", i.e., it is a plane from which the current is emanating, and therefore can be considered a "virtual anode" because it can be viewed as a location or source from which anodic current emanates, it is the relatively high-ionic-resistance of the CIRP (with respect to the electrolyte and with respect to regions outside of the CIRP) that leads the nearly uniform current across its face and to further advantageous, generally superior wafer uniformity when compared to having a metallic anode located at the same physical location. The plate's resistance to ionic current flow increases with increasing specific resistance of electrolyte contained within the various channels of the plate (often but not always having the same or nearly similar resistance of the catholyte), increased plate thickness, and reduced porosity (less fractional cross sectional area for current passage, for example, by having fewer holes of the same diameter, or the same number of holes with smaller diameters, etc.).

Structure

The CIRP is a disk of material that may be between about 2-25 mm thick, for example 12 mm thick. The CIRP contains a very large number of micro size (typically less than 0.04") through-holes representing less than about 5 percent of the volume of the CIRP, said through-holes being spatially and ionically isolated from each other such that they do not form interconnecting channels within the body of CIRP, in many but not all implementations. Such through-holes are often referred to as "non-communicating through-holes". They typically extend in one direction or dimension, which is often, but not necessarily, normal to the plated surface of the wafer (in some embodiments the non-communicating holes are at an angle with respect to the wafer which is generally parallel to the CIRP front surface). Often the through-holes are all substantially parallel to one another. In some embodiment the thickness of the CIRP plate is non-uniform. The CIRP plate may be thicker at the edge than at its center, or vise-versa. The surface of the CIRP farthest from the wafer may be shaped to tailor the local fluid and ionic flow resistance of the plate. Often the holes are arranged in a square array, but other arrangements that lead to a spatially average uniform density or holes are also possible. Of course the density of holes can also be varied, for example, by having the spacing increase (or decrease) from the CIRP center to edge, thereby increasing (or decreasing) the resistance with distance from the center of the CIRP. Other times the layout is in an offset spiral pattern. These through-holes are distinct from 3-D porous networks, where the channels extend in three dimensions and form interconnecting pore structures, because the through-holes restructure both ionic current flow and fluid flow parallel to the surface therein, and straighten the path of both current and fluid flow towards the wafer surface. However, in certain embodiments, such a porous plate, having an interconnected network of pores, may be used in place of the CIRP. When the distance from the plate's top surface to the wafer is small (e.g., a gap of about 1/10 the size of the wafer radius, for example about 5 mm or less), divergence of both current flow and fluid flow is locally restricted, imparted and aligned with the CIRP channels.

Figure 10A:
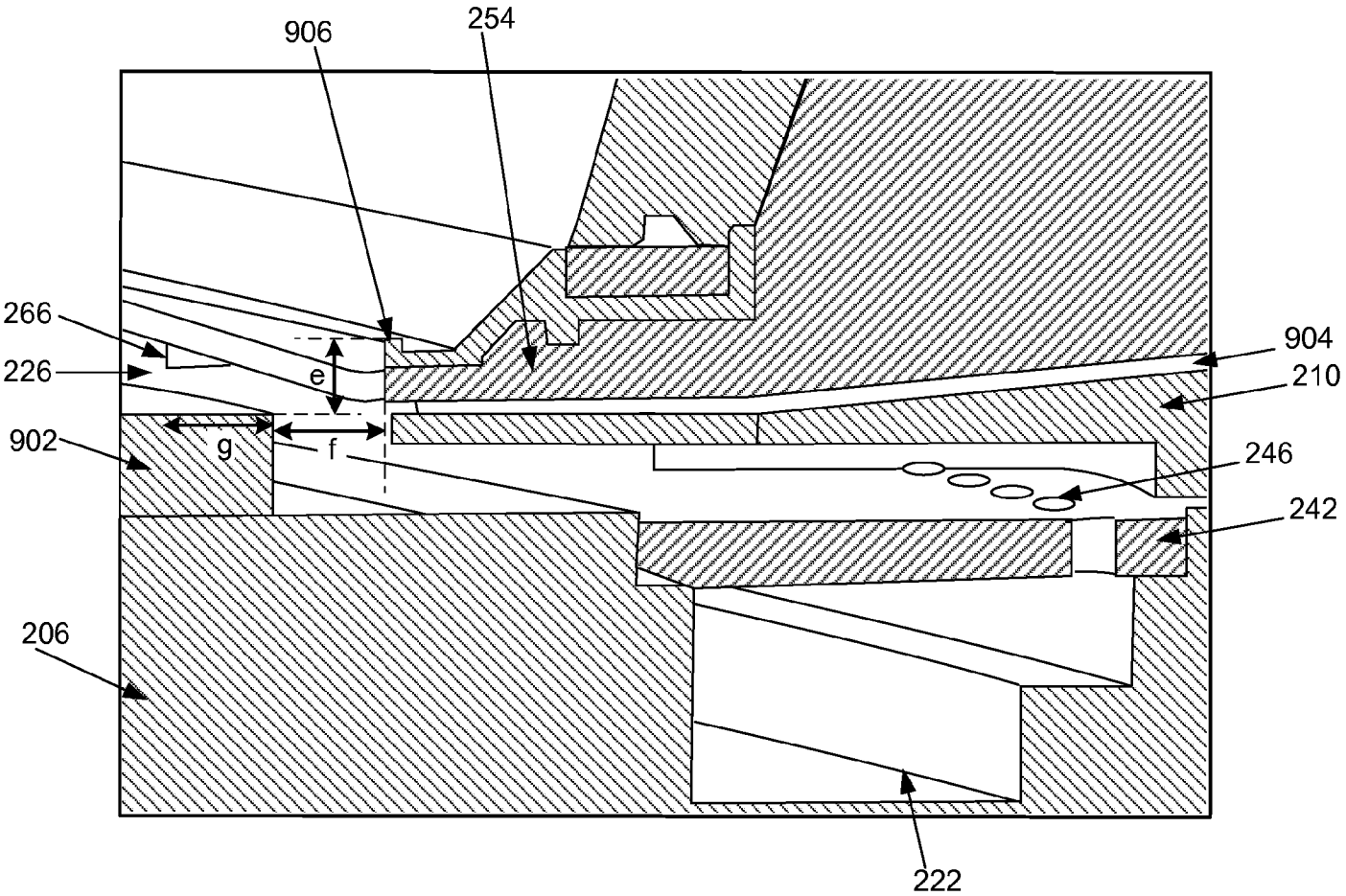
FIG. 10A shows a cross flow inlet region where a channeled ionically resistive plate having a step is used.
Figure 10B:
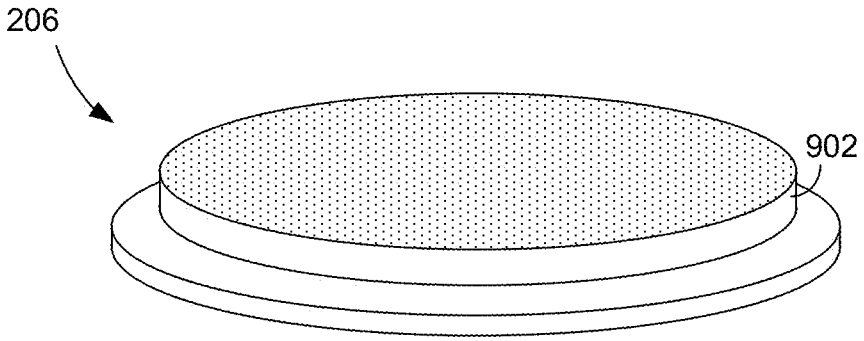
FIG. 10B shows an example of a channeled ionically resistive plate having a step.

In certain embodiments, the CIRP includes a step that is approximately coextensive with the diameter of the substrate (e.g., the diameter of the step may be within about 5% of the diameter of the substrate, for example within about 1%). A step is defined as a raised portion on the substrate-facing side of the CIRP, which is approximately coextensive with a substrate being plated. The step portion of the CIRP also contains through-holes that match with the through-holes in the main portion of the CIRP. An example of this embodiment is shown in FIGS. 10A and 10B. The purpose of the step 902 is to reduce the height of the cross flow manifold 226 and thereby increase the velocity of fluid traveling in this region without having to increase the volumetric flow rate. The step 902 may also be considered a plateau region, and may be implemented as a raised region of the CIRP 206 itself.

In many cases, the diameter of the step 902 should be slightly smaller than the inner diameter of the substrate holder 254 (e.g., the outer diameter of the step may be between about 2-10 mm smaller than the inner diameter of the substrate holder) and cross flow confinement ring 210. Without this difference in diameter (shown as distance (f)), a pinch point may undesirably form between the cup holder 254 and/or cross flow confinement ring 210 and the step 902, where it is difficult or impossible for fluid to flow up and into the cross flow manifold 226. Where this is the case, the fluid may undesirably escape through a fluid gap 904 above the cross flow confinement ring 210 and below the bottom surface of the substrate holder/cup 254. This fluid gap 904 is present as a matter of practicality, as the substrate holder 254 should be able to rotate with respect to the CIRP 206 and other elements of the plating cell. It is preferable to minimize the amount of catholyte that escapes through the fluid gap 904. The step 902 may have a height between about 2-5 mm, for example between about 3-4 mm, which may correspond to a cross flow manifold height between about 1-4 mm, or between about 1-2 mm, or less than about 2.5 mm.

Where a step is present, the height of the cross flow manifold is measured as the distance between the plating face of a wafer and the raised step 902 of the CIRP 206. In FIG. 10A, this height is shown as distance (e). While no substrate is shown in FIG. 10A, it is understood a plating face of a substrate would rest on the lipseal portion 906 of the substrate holder 254. In certain implementations, the step has a rounded edge to better allow fluid to pass into the cross flow manifold. In this case, the step may include a transition region about 2-4 mm wide where the surface of the step is rounded/sloped. Although FIG. 10A does not show a rounded step, distance (g) represents where such a transition region would be located. Radially inside of this transition region, the CIRP may be flat. The non-raised portion of the CIRP may extend around the entire periphery of the CIRP, as shown in FIG. 10B.

Figure 11:
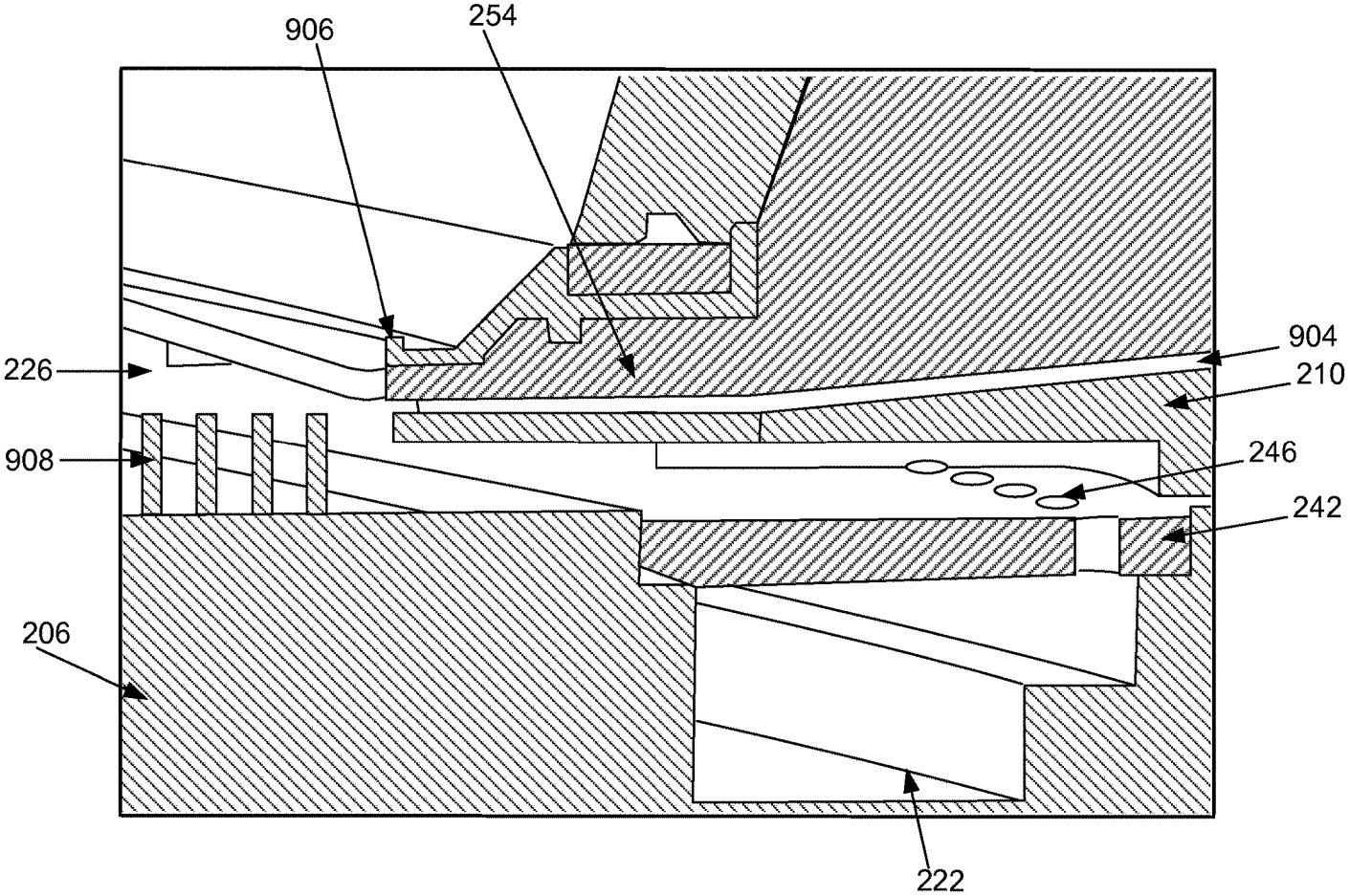
FIG. 11 shows a cross flow inlet region where a channeled ionically resistive plate having a series of protuberances is used.

In other embodiments, the CIRP may include a collection of protuberances on its upper surface. A protuberance is defined as a structure that is placed/attached on a substrate-facing side of a CIRP that extends into the cross flow manifold between the CIRP plane and the wafer. The CIRP plane (also referred to as an ionically resistive element plane) is defined as the top surface of the CIRP, excluding any protuberances. The CIRP plane is where the protuberances are attached to the CIRP, and is also where fluid exits the CIRP into the cross flow manifold. Examples of this embodiment are shown in FIGS. 1A and 11. FIG. 1A shows an isometric view of CIRP 150 having protuberances 151 oriented perpendicular to the direction of cross flow. FIG. 11 shows a close up view of an inlet portion of a plating apparatus having a CIRP 206 with protuberances 908. The CIRP 206 may include a peripheral region where no protuberances are located, in order to allow catholyte to travel up and into the cross flow manifold 226. This peripheral non-protuberance region may have a width as described above in relation to the distance between a step and a cup holder. In many cases, the protuberances are substantially coextensive with the plating face of a substrate being plated (e.g., the diameter of the protuberance region on the CIRP may be within about 5%, or within about 1%, of the diameter of the substrate).

Figure 12:
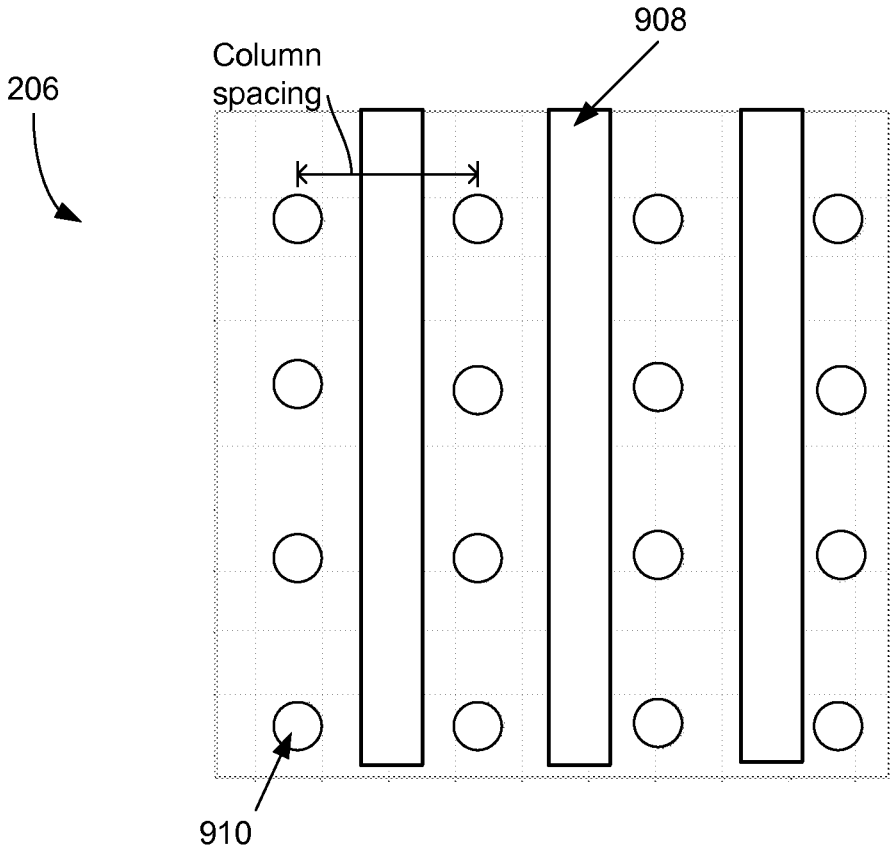
FIG. 12 shows a close-up view of a channeled ionically resistive plate having protuberances.

The protuberances may be oriented in a variety of manners, but in many implementations the protuberances are in the form of long, thin ribs located between columns of holes in the CIRP, and oriented such that the length of the protuberance is perpendicular to the cross flow through the cross flow manifold. A close-up view of a CIRP having long thin protuberances between columns of CIRP holes is shown in FIG. 12. The protuberances modify a flow field adjacent to the wafer to improve mass transfer to the wafer and improve the uniformity of the mass transfer over the entire face of the wafer. The protuberances may be machined into existing CIRP plates, in some cases, or they may be formed at the same time that a CIRP is fabricated. As shown in FIG. 12, the protuberances may be arranged such that they do not block the existing 1-D CIRP through-holes 910. In other words, the width of the protuberances 908 may be less than the distance between each column of holes 910 in the CIRP 206. In one example, the CIRP holes 910 are located 2.69 mm apart, center-to-center, and the holes are 0.66 mm in diameter. Thus, the protuberances will be less than about 2 mm wide (2.69−2*(0.66/2) mm=2.03 mm). In certain cases, the protuberances may be less than about 1 mm wide. In certain cases, the protuberances have a length to width aspect ratio of at least about 3:1.

In many implementations, the protuberances are oriented such that their length is perpendicular or substantially perpendicular to the direction of cross flow across the face of the wafer (sometimes referred to as the "z" direction herein). In certain cases, the protuberances are oriented at a different angle or set of angles.

A wide variety of protuberance shapes, sizes and layouts may be used. In some embodiments, the protuberances have a face which is substantially normal to the face of the CIRP, while in other implementations the protuberances have a face which is positioned at an angle relative to the face of the CIRP. In yet further implementations, the protuberances may be shaped such that they do not have any flat faces. Some embodiments may employ a variety of protuberance shapes and/or sizes and/or orientations.

Figure 13:
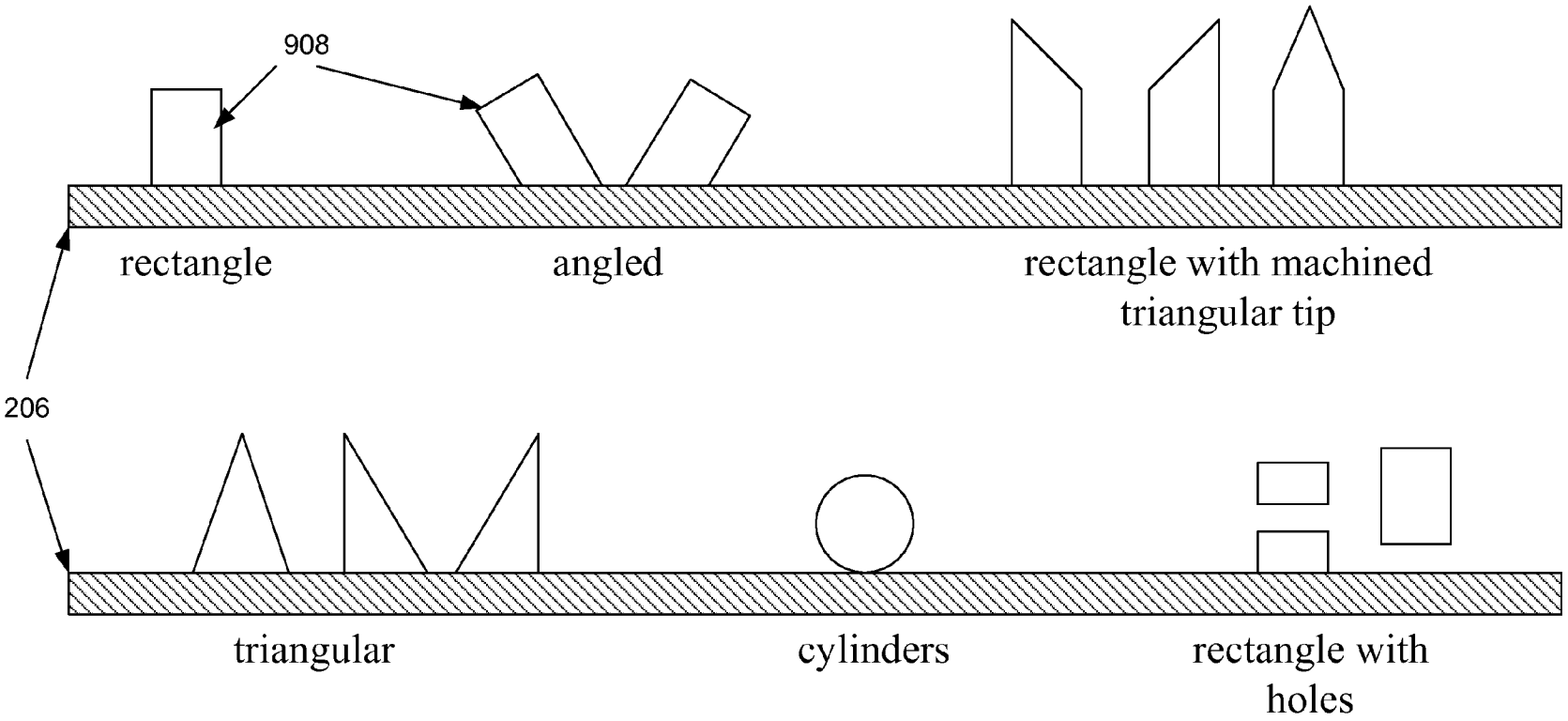
FIGS. 13 and 14 present different shapes and designs for protuberances according to certain embodiments.

FIG. 13 provides examples of protuberance shapes, shown as cross sections of protuberances 908 on CIRP 206. In some implementations, the protuberances are generally rectangularly shaped. In other implementations, the protuberances are triangular, cylindrical, or some combination thereof. The protuberances may also be generally rectangular with a machined triangular tip. In certain embodiments the protuberances may include holes through them, oriented substantially parallel to the direction of cross flow across the wafer.

Figure 14:
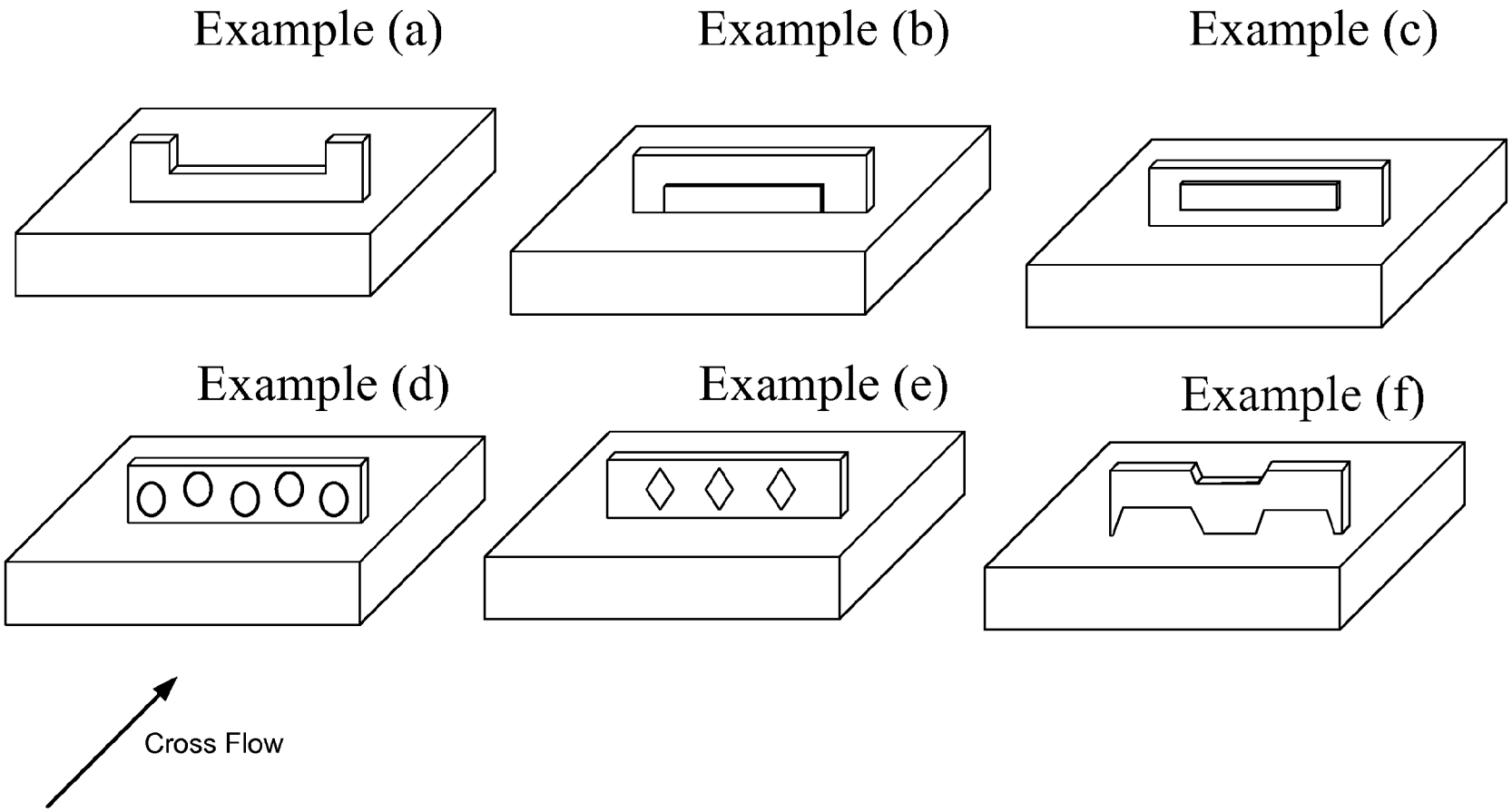

FIG. 14 provides several examples of protuberances having different types of through-holes. The through-holes may also be referred to as flow relief structures, cutouts, or cutout portions. The through-holes help disrupt the flow pattern such that the flow is convoluted in all directions (x-direction, y-direction and z-direction) Example (a) shows a protuberance having a top portion cut out in a rectangular pattern, example (b) shows a protuberance having a bottom portion cut out in a rectangular pattern, example (c) shows a protuberance having a middle portion cut out in a rectangular pattern, example (d) shows a protuberance having a series of holes cut out in circle/oval patterns, example (e) shows a protuberance having a series of holes cut out in diamond patterns, and example (f) shows a protuberance having top and bottom portions alternately cut out in a trapezoid pattern. The holes may be horizontally in line with one another, or they may be offset from one another as shown in examples (d) and (f).

Figure 15:
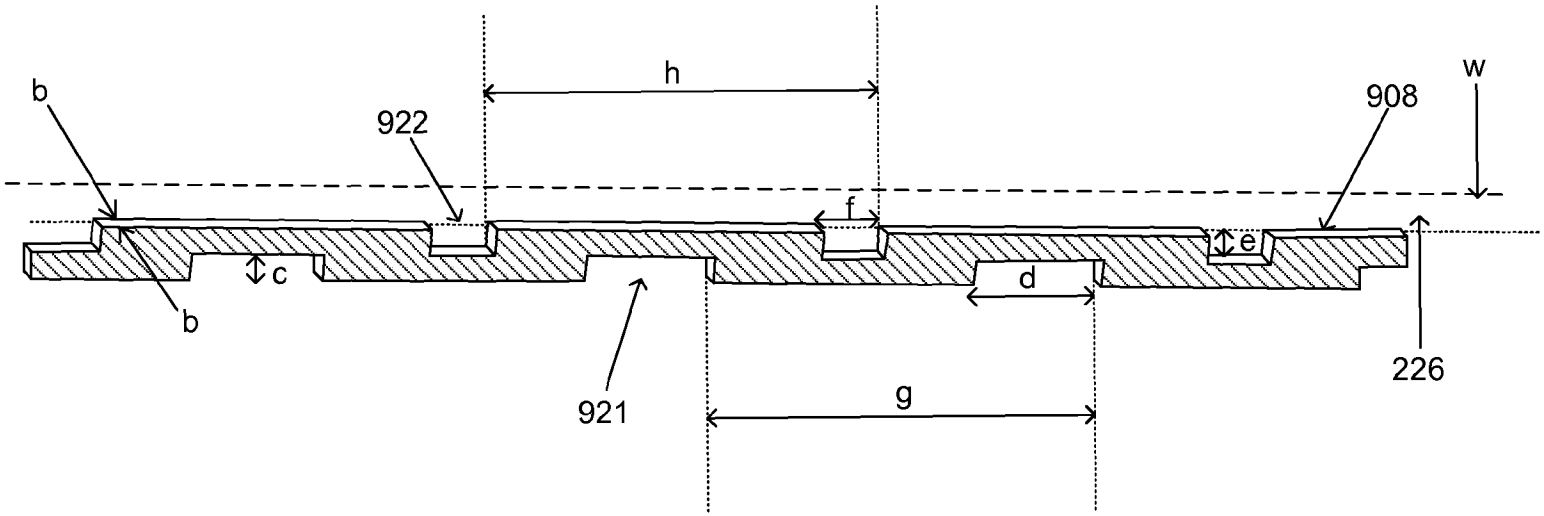
FIG. 15 shows a protuberance having two different kinds of cutouts.

FIG. 15 shows an example of a protuberance 908 having alternating types of cutouts, similar to the embodiment of example (e) in FIG. 14. Here, two types of cutouts are used, referred to as a first cutout 921 and a second cutout 922. In this embodiment, the first cutout 921 is on the bottom portion of the protuberance 908 and the second cutout 922 is on the top portion of the protuberance 908. The overall protuberance may have a height (a) between about 1-5 mm, and a thickness (b) between about 0.25-2 mm. The first cutout may have a height (c) between about 0.2-3 mm, and a length (d) between about 2-20 mm. The second cutout 922, located on the top portion of the protuberance 908, may also have a height (e) between about 0.2-3 mm, and a length (f) between about 2-20 mm. The distance (g) between adjacent first cutouts 921 (i.e., the period of the first cutouts 921) may be between about 4-50 mm. The distance (h) between adjacent second cutouts 922 (i.e., the period of the second cutouts) may also be between about 4-50 mm. These dimensions are provided for the sake of understanding and are not intended to be limiting. The wafer plane (w) is shown above the protuberance 908. Between the base of protuberance 908, which is attached to the CIRP, and the wafer plane (w) is the cross flow manifold 226.

Figure 16:
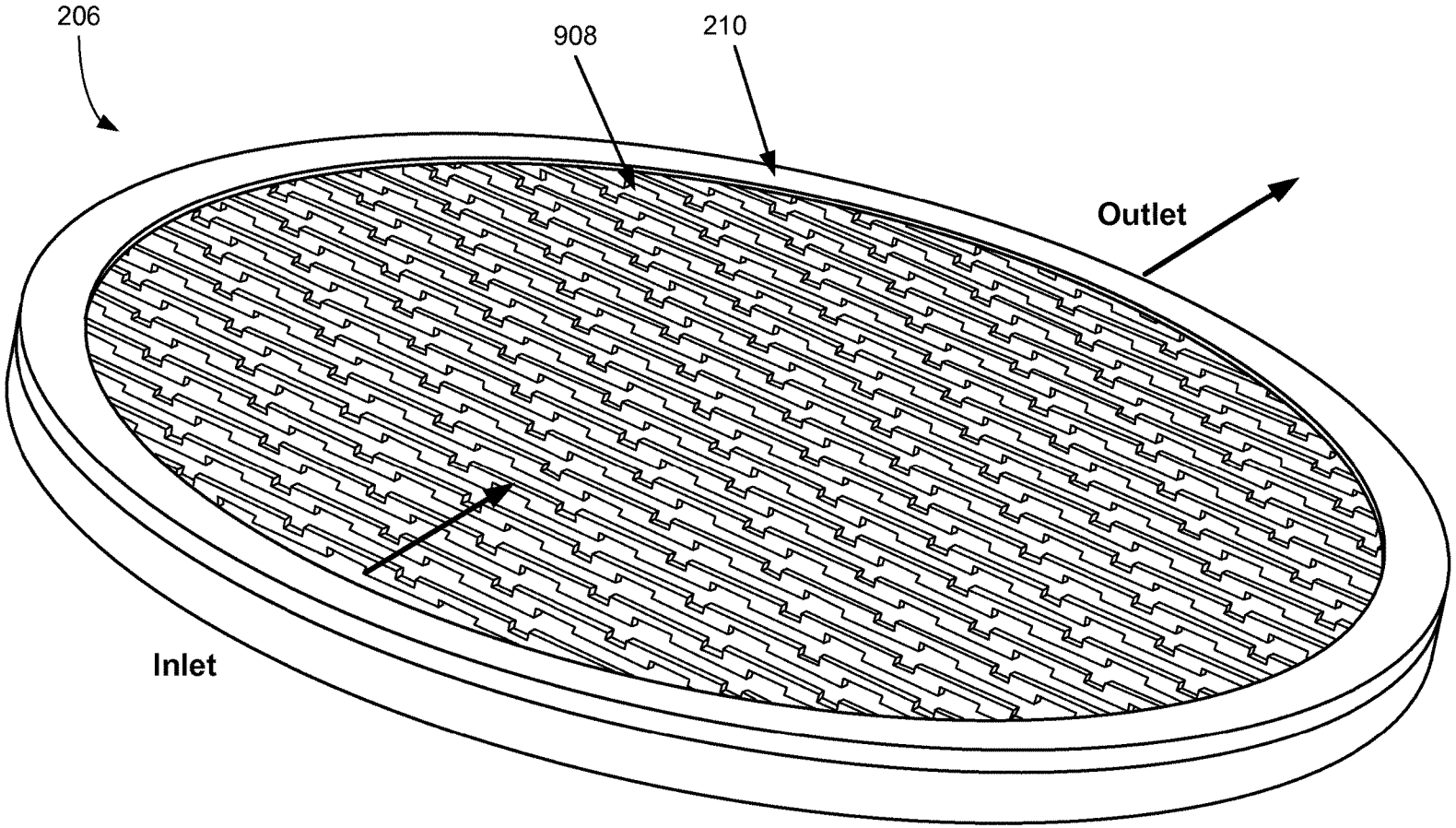
FIG. 16 depicts a channeled ionically resistive plate having the type of protuberances shown in FIG. 15.

FIG. 16 shows an embodiment of a CIRP 206 having the type of protuberance 908 shown in FIG. 15. Also shown in FIG. 16 is the cross flow confinement ring 210. One of ordinary skill would understand that many different types of protuberances and cutouts may be used within the scope of the disclosed embodiments.

Figure 17:
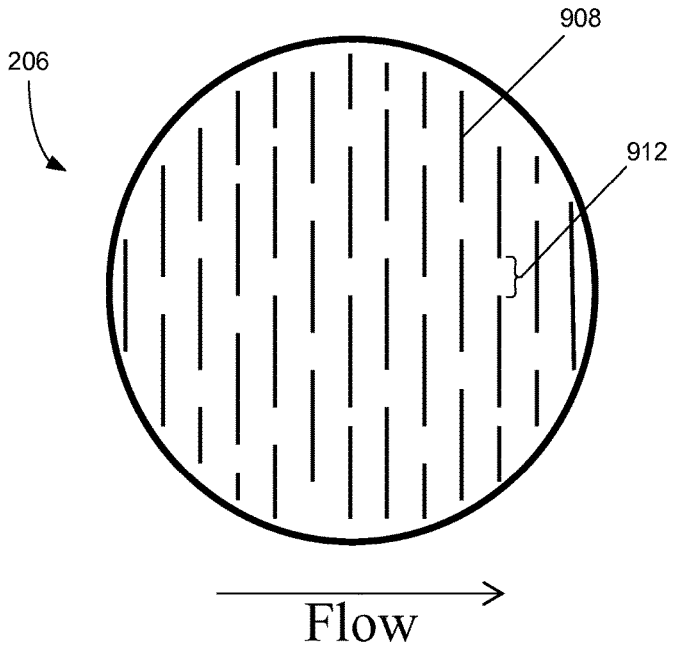
FIG. 17 depicts a simplified top-down view of a channeled ionically resistive plate having non-continuous protuberances that are separated within a column by gaps.

Some implementations may utilize protuberances which have gaps (sometimes referred to as non-protuberance gaps) such that two or more separate/discontinuous protuberances are located in the same column of CIRP holes. FIG. 17 shows an example CIRP 206 having protuberances 908 with non-protuberance gaps 912. The gaps 912 in the protuberances 908 may be designed so that they substantially do not align with one another in the direction of cross flow. For example, in FIG. 17, the gaps 912 do not align with one another between adjacent columns of protuberances 908. This purposeful misalignment of gaps 912 may help encourage mixing of impinging flow and cross flow in the cross flow manifold to promote uniform plating results.

In some implementations, there is a protuberance between each column of holes in the CIRP, while in other implementations there may be fewer protuberances. For example, in certain embodiments there may be a protuberance for every other column of CIRP holes, or a protuberance for every fourth column of CIRP holes, etc. In further embodiments, the protuberance locations may be more random.

One relevant parameter in optimizing the protuberances is the height of the protuberance, or relatedly, the distance between the top of the protuberance and the bottom of the wafer surface, or the ratio of protuberance height to CIRP to wafer channel height. In certain implementations, the protuberances are between about 2-5 mm tall, for example about 4-5 mm tall. The distance between the top of the protuberance and the bottom of the wafer may be between about 1-4 mm, for example about 1-2 mm, or less than about 2.5 mm. The ratio of the protuberance height to the height of the cross flow manifold may be between about 1:3 and 5:6. Where protuberances are present, the height of the cross flow manifold is measured as the distance between the plating face of the wafer and the plane of the CIRP, excluding any protuberances.

Figure 18:
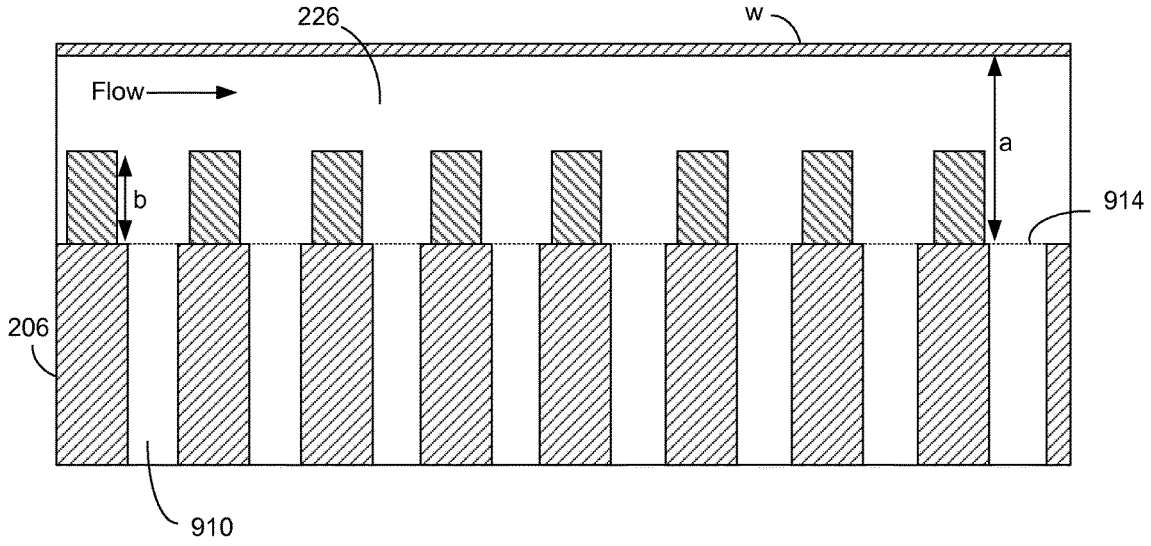
FIG. 18 shows a close-up cross sectional view of a channeled ionically resistive plate having protuberances.

FIG. 18 shows an example close-up cross sectional view of a CIRP 206 having protuberances 908 positioned between the holes 910 in the CIRP 206. The cross flow manifold 226 occupies the space between the wafer plane (w) and the CIRP plane 914. The cross flow manifold 226 may have a height between about 3-8 mm, for example between about 4-6 mm. In a particular embodiment this height is about 4.75 mm. The protuberances 908 are positioned between the columns of holes 910 in the CIRP 206, and have a height (b) as described above that is less than the height (a) of the cross flow manifold 226.

Figure 19:
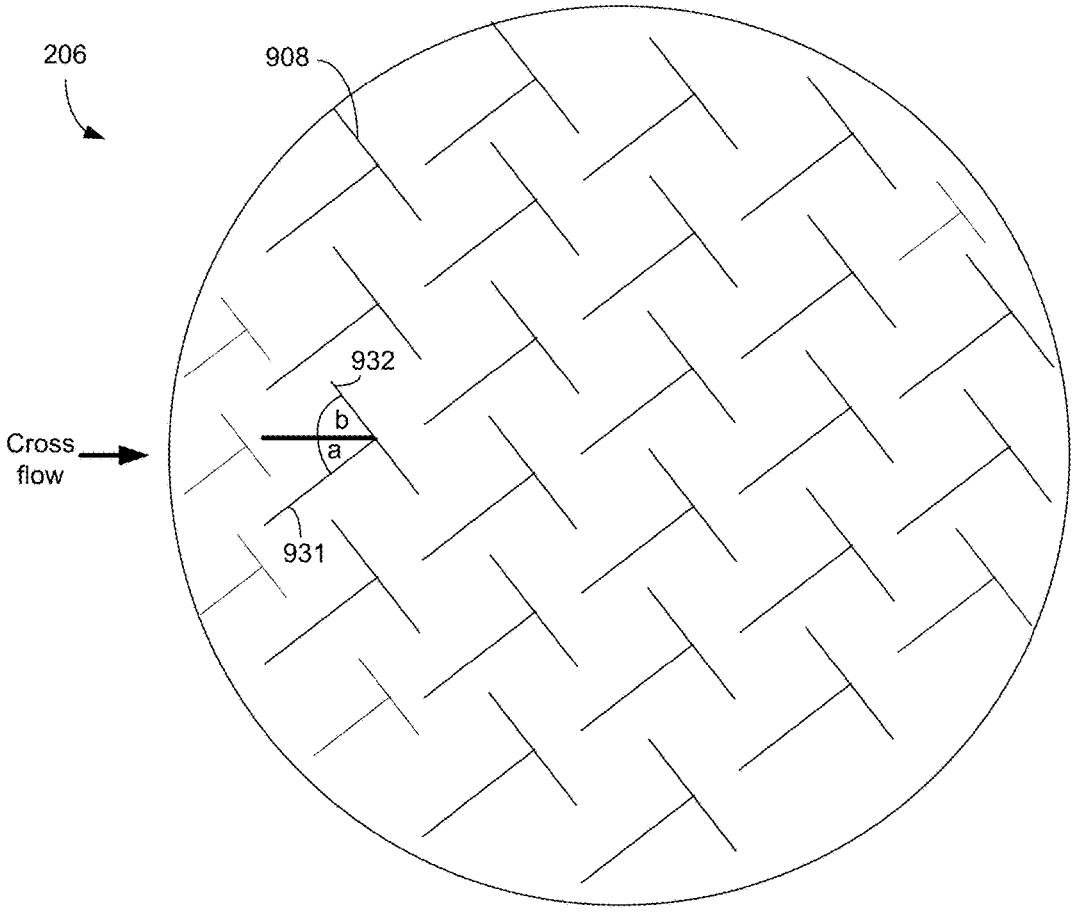
FIG. 19 illustrates a simplified top-down view of an embodiment of a channeled ionically resistive plate where the protuberances are made of multiple segments.

FIG. 19 shows a top-down simplified view of an alternative embodiment of a CIRP 206 having protuberances 908 oriented in a different manner. In this embodiment, each protuberance 908 is made of two segments 931 and 932. For the purpose of clarity, only a single protuberance and single set of protuberance segments are labeled. The segments 931 and 932 are oriented perpendicularly to one another, and are of identical or substantially similar (e.g., within about 10% of one another) length. In other embodiments, these segments 931 and 932 may be oriented at a different angle relative to one another, and may have differing lengths. In further embodiments, the two segments 931 and 932 may be disconnected from one another such that there are two (or more) separate types of protuberances, each oriented at an angle relative to the cross flow. In FIG. 19, the direction of cross flow is left-to-right, as indicated. Each segment 931 and 932 of the protuberance 908 is oriented at an angle relative to the cross flow, as shown by angles (a) and (b). The line bisecting angles (a) and (b) is intended to represent the overall direction of cross flow. In certain cases, these angles are identical or substantially similar (e.g., within about 10% of one another). This embodiment differs from the one shown in FIG. 1A, for example, because the protuberances 908 are not individually oriented in a direction perpendicular to the cross flow. However, because angles a and b are substantially similar, and because the length of the protuberance segments are substantially similar, the protuberances may be considered to be, on average, oriented perpendicular to the direction of cross flow.

In various cases, the CIRP is a disc made of a solid, non-porous dielectric material that is ionically and electrically resistive. The material is also chemically stable in the plating solution of use. In certain cases the CIRP is made of a ceramic material (e.g., aluminum oxide, stannic oxide, titanium oxide, or mixtures of metal oxides) or a plastic material (e.g., polyethylene, polypropylene, polyvinylidene difluoride (PVDF), polytetrafluoroethylene, polysulphone, polyvinyl chloride (PVC), polycarbonate, and the like), having between about 6,000-12,000 non-communicating through-holes. The disc, in many embodiments, is substantially coextensive with the wafer (e.g., the CIRP disc has a diameter of about 300 mm when used with a 300 mm wafer) and resides in close proximity to the wafer, e.g., just below the wafer in a wafer-facing-down electroplating apparatus. Preferably, the plated surface of the wafer resides within about 10 mm, more preferably within about 5 mm of the closest CIRP surface. To this end, the top surface of the channeled ionically resistive plate may be flat or substantially flat. In certain cases, both the top and bottom surfaces of the channeled ionically resistive plate are flat or substantially flat.

Another feature of the CIRP is the diameter or principal dimension of the through-holes and its relation to the distance between the CIRP and the substrate. In certain embodiments, the diameter of each through-hole (or of a majority of through-holes, or the average diameter of the through-holes) is no more than about the distance from the plated wafer surface to the closest surface of the CIRP. Thus, in such embodiments, the diameter or principal dimension of the through-holes should not exceed about 5 mm, when the CIRP is placed within about 5 mm of the plated wafer surface.

As above, the overall ionic and flow resistance of the plate is dependent on the thickness of the plate and both the overall porosity (fraction of area available for flow through the plate) and the size/diameter of the holes. Plates of lower porosities will have higher impinging flow velocities and ionic resistances. Comparing plates of the same porosity, one having smaller diameter 1-D holes (and therefore a larger number of 1-D holes) will have a more micro-uniform distribution of current on the wafer because there are more individual current sources, which act more as point sources that can spread over the same gap, and will also have a higher total pressure drop (high viscous flow resistance).

In certain cases, however, the ionically resistive plate is porous, as mentioned above. The pores in the plate may not form independent 1-D channels, but may instead form a mesh of through-holes which may or may not interconnect. It should be understood that as used herein, the terms channeled ionically resistive plate (CIRP) and channeled ionically resistive element are intended to include this embodiment, unless otherwise noted.

Vertical Flow Through the Through-Holes

The presence of an ionically resistive but ionically permeable element (CIRP) 206 close to the wafer substantially reduces the terminal effect and improves radial plating uniformity in certain applications where terminal effects are operative/relevant, such as when the resistance of electrical current in the wafer seed layer is large relative to that in the catholyte of the cell. The CIRP also simultaneously provides the ability to have a substantially spatially-uniform impinging flow of electrolyte directed upwards at the wafer surface by acting as a flow diffusing manifold plate. Importantly, if the same element is placed farther from the wafer, the uniformity of ionic current and flow improvements become significantly less pronounced or non-existent.

Further, because non-communicating through-holes do not allow for lateral movement of ionic current or fluid motion within the CIRP, the center-to-edge current and flow movements are blocked within the CIRP, leading to further improvement in radial plating uniformity.

It is noted that in some embodiments, the CIRP plate can be used primarily or exclusively as an intra-cell electrolyte flow resistive, flow controlling and thereby flow shaping element, sometimes referred to as a turboplate. This designation may be used regardless of whether or not the plate tailors radial deposition uniformity by, for example, balancing terminal effects and/or modulating the electric field or kinetic resistances of plating additives coupled with the flow within the cell. Thus, for example, in TSV and WLP electroplating, where the seed metal thickness is generally large (e.g. >1000 Å thick) and metal is being deposited at very high rates, uniform distribution of electrolyte flow is very important, while radial non-uniformity control arising from ohmic voltage drop within the wafer seed may be less necessary to compensate for (at least in part because the center-to-edge non-uniformities are less severe where thicker seed layers are used). Therefore the CIRP plate can be referred to as both an ionically resistive ionically permeable element, and as a flow shaping element, and can serve a deposition-rate corrective function by either altering the flow of ionic current, altering the convective flow of material, or both.

Distance Between Wafer and Channeled Plate

In certain embodiments, a wafer holder and associated positioning mechanism hold a rotating wafer very close to the parallel upper surface of the channeled ionically resistive element. During plating, the substrate is generally positioned such that it is parallel or substantially parallel to the ionically resistive element (e.g., within about 10°). Though the substrate may have certain features thereon, only the generally planar shape of the substrate is considered in determining whether the substrate and ionically resistive element are substantially parallel.

In typical cases, the separation distance is about 1-10 millimeters, or about 2-8 millimeters. This small plate to wafer distance can create a plating pattern on the wafer associated with proximity "imaging" of individual holes of the pattern, particularly near the center of wafer rotation. In such circumstances, a pattern of plating rings (in thickness or plated texture) may result near the wafer center. To avoid this phenomenon, in some embodiments, the individual holes in the CIRP (particularly at and near the wafer center) can be constructed to have a particularly small size, for example less than about $1/5^{th}$ the plate to wafer gap. When coupled with wafer rotation, the small pore size allows for time averaging of the flow velocity of impinging fluid coming up as a jet from the plate and reduces or avoids small scale non-uniformities (e.g., those on the order of micrometers). Despite the above precaution, and depending on the properties of the plating bath used (e.g. particular metal deposited, conductivities, and bath additives employed), in some cases deposition may be prone to occur in a micro-non-uniform pattern (e.g., forming center rings) as the time average exposure and proximity-imaging-pattern of varying thickness (for example, in the shape of a "bulls eye" around the wafer center) and corresponding to the individual hole pattern used. This can occur if the finite hole pattern creates an impinging flow pattern that is non-uniform and influences the deposition. In this case, introducing lateral flow across the wafer center, and/or modifying the regular pattern of holes right at and/or near the center, have both been found to largely eliminate any sign of micro-non-uniformities otherwise found there.

Porosity of Channeled Plate

In various embodiments, the channeled ionically resistive plate has a sufficiently low porosity and pore size to provide a viscous flow resistance backpressure and high vertical impinging flow rates at normal operating volumetric flow rates. In some cases, about 1-10% of the channeled ionically resistive plate is open area allowing fluid to reach the wafer surface. In particular embodiments, about 2-5% the plate is open area. In a specific example, the open area of the plate 206 is about 3.2% and the effective total open cross sectional area is about 23 $cm^2$.

Hole Size of Channeled Plate

The porosity of the channeled ionically resistive plate can be implemented in many different ways. In various embodiments, it is implemented with many vertical holes of small diameter. In some cases the plate does not consist of individual "drilled" holes, but is created by a sintered plate of continuously porous material. Examples of such sintered plates are described in U.S. Pat. No. 6,964,792, which is herein incorporated by reference in its entirety. In some embodiments, drilled non-communicating holes have a diameter of about 0.01 to 0.05 inches. In some cases, the holes have a diameter of about 0.02 to 0.03 inches. As mentioned above, in various embodiments the holes have a diameter that is at most about 0.2 times the gap distance between the channeled ionically resistive plate and the wafer. The holes are generally circular in cross section, but need not be. Further, to ease construction, all holes in the plate may have the same diameter. However this need not be the case, and both the individual size and local density of holes may vary over the plate surface as specific requirements may dictate.

As an example, a solid plate made of a suitable ceramic or plastic material (generally a dielectric insulating and mechanically robust material), having a large number of small holes provided therein, e.g. at least about 1000 or at least about 3000 or at least about 5000 or at least about 6000 (9465 holes of 0.026 inches diameter has been found useful). As mentioned, some designs have about 9000 holes. The porosity of the plate is typically less than about 5 percent so that the total flow rate necessary to create a high impinging velocity is not too great. Using smaller holes helps to create a large pressure drop across the plate as compared to larger holes, aiding in creating a more uniform upward velocity through the plate.

Generally, the distribution of holes over the channeled ionically resistive plate is of uniform density and non-random. In some cases, however, the density of holes may vary, particularly in the radial direction. In a specific embodiment, as described more fully below, there is a greater density and/or diameter of holes in the region of the plate that directs flow toward the center of the rotating substrate. Further, in some embodiments, the holes directing electrolyte at or near the center of the rotating wafer may induce flow at a non-right angle with respect to the wafer surface. Further, the hole patterns in this region may have a random or partially random distribution of non-uniform plating "rings" to address possible interaction between a limited number of holes and the wafer rotation. In some embodiments, the hole density proximate an open segment of a flow diverter or confinement ring is lower than on regions of the channeled ionically resistive plate that are farther from the open segment of the attached flow diverter or confinement ring.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed.

The subject matter of the present disclosure includes all novel and nonobvious combinations and sub-combinations of the various processes, systems and configurations, and other features, functions, acts, and/or properties disclosed herein, as well as any and all equivalents thereof.

Examples and Experimental

Modeling results and on-wafer experimental results suggest that the disclosed embodiments can substantially increase the uniformity of a plating process. FIG. 20 presents a summary of some experimental results for copper electroplating. Two different CIRP designs were tested (with and without protuberances), at each of two different deposition rates.

The first CIRP design was a control design in which no step or protuberances were used. The second CIRP design included a collection of 2.5 mm tall protuberances positioned between adjacent columns of CIRP holes, and oriented in a direction perpendicular to the cross flow. The height of the cross flow manifold was about 4.75 mm. The two copper deposition rates tested were 2.4 and 3.2 μm/min. In other words, the current delivered during each experiment was the level of current needed to deposit, on average, about 2.4 or 3.2 μm/min of metal. The plating chemistry used in the experiments was SC40 chemistry from Enthone of West Haven, Conn. having a sulfuric acid concentration of about 140 g/L and a cupric ion (Cu2+) concentration of about 40 g/L (from copper sulfate). The concentration of R1 and R2 additives in the catholyte were 20 and 12 mL/L, respectively. The flow rate of catholyte was about 20 L/min. The substrate rotated at a rate of about 4 RPM. A fluid gap between the upper surface of the cross flow confinement ring and the lower surface of the plating cup was about 0.5 mm. The plating process was run at about 30° C. The post-plating bump height was measured at many different locations across the surface of each wafer.

In all the cases, the bump heights were somewhat thicker near the edge of a wafer and thinner near the center of the wafer. However, the variation in thickness was smaller for the CIRP with protuberances than for the control CIRP at both deposition rates. Thus, the CIRP with protuberances showed a clear improvement in bump height thickness distribution. The coplanarity was substantially the same between the control case and the protuberance case, but is expected to be superior for the protuberance under conditions of intense mass transport (e.g., at deposition rates >4 μm/min for copper). Die coplanarity is defined as (½×(Max Bump Height−Min Bump Height)/Avg Bump Height for a given die. The wafer coplanarity reported in FIG. 20 is an average of all the die coplanarity for the given wafer. In this case, there were approximately 170 dies for a particular test wafer.

Additional modeling results demonstrating the effectiveness of protuberances is included in U.S. Provisional Application No. 61/736,499, which was incorporated by reference above.

Other Embodiments

While the above is a full description of the specific embodiments, various modifications, alternative constructions and equivalents may be used. Therefore, the above description and illustrations should not be taken as limiting the scope of the present invention which is defined by the appended claims.

What is claimed is:

1. An electroplating apparatus comprising:

(a) an electroplating chamber configured to contain an electrolyte and an anode while electroplating metal onto a substantially planar substrate;

(b) a substrate holder configured to hold the substantially planar substrate such that a plating face of the substrate is separated from the anode during electroplating;

(c) an ionically resistive element comprising:

(i) a plurality of channels extending through the ionically resistive element and adapted to provide ionic transport through the ionically resistive element during electroplating;

(ii) a substrate-facing side that is substantially parallel to the plating face of the substrate and separated from the plating face of the substrate by a gap; and (iii) a plurality of protuberances positioned on the substrate-facing side of the ionically resistive element;

(d) an inlet to the gap for introducing cross flowing electrolyte to the gap; and (e) an outlet to the gap for receiving cross flowing electrolyte flowing in the gap, wherein the inlet and outlet are positioned proximate azimuthally opposing perimeter locations on the plating face of the substrate during electroplating.

2. The electroplating apparatus of claim 1, wherein the gap between the substrate-facing side of the ionically resistive element and the plating face of the substrate is less than about 15 mm, as measured between the plating face of the substrate and an ionically resistive element plane.

3. The electroplating apparatus of claim 1, wherein a gap between the plating face of the substrate and an uppermost height of the protuberances is between about 0.5-4 mm.

4. The electroplating apparatus of claim 1, wherein the protuberances have a height between about 2-10 mm.

5. The electroplating apparatus of claim 1, wherein the protuberances are oriented, on average, substantially perpendicular to the direction of cross flowing electrolyte.

6. The electroplating apparatus of claim 1, wherein at least some of the protuberances have a length to width aspect ratio of at least about 3:1, wherein the protuberance length is oriented in a direction substantially perpendicular to a direction of cross flowing electrolyte between the inlet to the gap and the outlet to the gap, and wherein the protuberance width is oriented in a direction substantially parallel to the direction of cross flowing electrolyte.

7. The electroplating apparatus of claim 1, wherein at least two different shapes and/or sizes of protuberances are present on the ionically resistive element.

8. The electroplating apparatus of claim 1, further comprising one or more cutout portions on at least some of the protuberances, through which electrolyte may flow during electroplating.

9. The electroplating apparatus of claim 1, wherein at least some of the protuberances comprise a face that is substantially normal to an ionically resistive element plane.

10. The electroplating apparatus of claim 1, wherein at least some of the protuberances comprise a face that is offset from an ionically resistive element plane by a non-right angle.

11. The electroplating apparatus of claim 1, further comprising a triangular upper portion on at least some of the protuberances.

12. The electroplating apparatus of claim 1, wherein the protuberances comprise at least a first protuberance segment and a second protuberance segment, and wherein the first and second protuberance segments are offset from the direction of cross flowing electrolyte by angles that are substantially similar but of opposite sign.

13. The electroplating apparatus of claim 1, wherein the ionically resistive element is configured to shape an electric field and control electrolyte flow characteristics proximate the substrate during electroplating.

14. The electroplating apparatus of claim 1, further comprising a cross flow injection manifold fluidically coupled to the inlet, wherein the cross flow injection manifold is at least partially defined by a cavity in the ionically resistive element.

15. The electroplating apparatus of claim 1, further comprising a flow confinement ring positioned over a peripheral portion of the ionically resistive element.

16. The electroplating apparatus of claim 1, wherein the inlet spans an arc between about 90-180° proximate the perimeter of the plating face of the substrate.

17. The electroplating apparatus of claim 1, further comprising a plurality of azimuthally distinct segments in the inlet, a plurality of electrolyte feed inlets configured to deliver electrolyte to the plurality of azimuthally distinct inlet segments, and one or more flow control elements configured to independently control a plurality of volumetric flow rates of electrolyte in the plurality of electrolyte feed inlets during electroplating.

18. The electroplating apparatus of claim 1, wherein the protuberances are substantially coextensive with the plating face of the substrate.

19. The electroplating apparatus of claim 1, wherein the protuberances are oriented in a plurality of parallel columns, wherein the columns include two or more discontinuous protuberances separated by a non-protuberance gap, and wherein the non-protuberance gaps in adjacent columns are substantially not aligned with one another in the direction of cross flowing electrolyte.

20. A channeled ionically resistive plate for use in an electroplating apparatus to plate material on a semiconductor wafer of standard diameter, comprising:

a plate that is approximately coextensive with a plating face of the semiconductor wafer, wherein the plate has a thickness between about 2-25 mm;

at least about 1000 non-communicating through-holes extending through the thickness of the plate, wherein the through-holes are adapted to provide ionic transport through the plate during electroplating; and a plurality of protuberances positioned on one side of the plate.

21. A method for electroplating a substrate comprising:

(a) receiving a substantially planar substrate in a substrate holder, wherein a plating face of the substrate is exposed, and wherein the substrate holder is configured to hold the substrate such that the plating face of the substrate is separated from the anode during electroplating;

(b) immersing the substrate in electrolyte, wherein a gap is formed between the plating face of the substrate and an ionically resistive element, wherein the ionically resistive element is at least about coextensive with the plating face of the substrate, wherein the ionically resistive element is adapted to provide ionic transport through the ionically resistive element during electroplating, and wherein the ionically resistive element comprises a plurality of protuberances on a substrate-facing side of the ionically resistive element, the protuberances being substantially coextensive with the plating face of the substrate;

(c) flowing electrolyte in contact with the substrate in the substrate holder (i) from a side inlet, into the gap, and out a side outlet, and (ii) from below the ionically resistive element, through the ionically resistive element, into the gap, and out the side outlet, wherein the side inlet and side outlet are designed or configured to generate cross flowing electrolyte in the gap during electroplating;

(d) rotating the substrate holder; and (e) electroplating material onto the plating face of the substrate while flowing the electrolyte as in (c).

22. The electroplating apparatus of claim 17, wherein the flow control elements comprise fluidic adjustment rods positioned to independently control the plurality of volumetric flow rates of electrolyte in the plurality of electrolyte feed inlets.

* * * * *